US011143990B2

(12) United States Patent
Handa

(10) Patent No.: US 11,143,990 B2
(45) Date of Patent: Oct. 12, 2021

(54) IMAGE FORMING APPARATUS

(71) Applicant: FUJIFILM Business Innovation Corp., Tokyo (JP)

(72) Inventor: Osamu Handa, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/820,119

(22) Filed: Mar. 16, 2020

(65) Prior Publication Data

US 2021/0072672 A1 Mar. 11, 2021

(30) Foreign Application Priority Data

Sep. 10, 2019 (JP) ..... JP2019-164714

(51) Int. Cl.
*G03G 15/16* (2006.01)

(52) U.S. Cl.
CPC ..... *G03G 15/1675* (2013.01); *G03G 15/165* (2013.01); *G03G 15/1645* (2013.01)

(58) Field of Classification Search
None
See application file for complete search history.

(56) References Cited

U.S. PATENT DOCUMENTS

2004/0022553 A1* 2/2004 Johnson ..... G03G 15/5004 399/75
2007/0047986 A1* 3/2007 Fujimori ..... G03G 15/5058 399/49
2010/0061750 A1* 3/2010 Okada ..... G03G 15/169 399/55
2012/0308249 A1* 12/2012 Matsumoto ..... G03G 15/161 399/66
2013/0136477 A1* 5/2013 Ogiyama ..... G03G 15/5029 399/66

(Continued)

FOREIGN PATENT DOCUMENTS

JP 2003-302846 A 10/2003
JP 2004-45897 A 2/2004

(Continued)

*Primary Examiner* — Sevan A Aydin
(74) *Attorney, Agent, or Firm* — Sughrue Mion, PLLC

(57) ABSTRACT

An image forming apparatus includes a revolving member, a transfer member, a guide member, and a controller. The revolving member revolves and retains a toner image on a peripheral surface thereof. The transfer member nips a transported recording medium and the revolving member at a nipping section and transfers the toner image retained by the revolving member onto the recording medium by receiving a voltage. The guide member is connected to ground, guides the recording medium to the nipping section, and is in contact with the recording medium nipped at the nipping section. The controller performs constant current control to transfer the toner image onto the recording medium if a print resistance is lower than or equal to a system resistance. The print resistance corresponds to when the voltage is applied to the transfer member in a state where the recording medium is nipped at the nipping section. The system resistance corresponds to when the voltage is applied to the transfer member in a state where the recording medium is not nipped at the nipping section.

17 Claims, 19 Drawing Sheets

(56) References Cited

U.S. PATENT DOCUMENTS

| | | | | |
|---|---|---|---|---|
| 2015/0362866 | A1* | 12/2015 | Matsushita | G03G 21/203 399/44 |
| 2018/0173142 | A1* | 6/2018 | Hara | G03G 15/2039 |

FOREIGN PATENT DOCUMENTS

| | | | | |
|---|---|---|---|---|
| JP | 2004045897 | A | * | 2/2004 |
| JP | 4946081 | B2 | | 6/2012 |

* cited by examiner

IMAGE FORMING APPARATUS

CROSS-REFERENCE TO RELATED APPLICATIONS

This application is based on and claims priority under 35 USC 119 from Japanese Patent Application No. 2019-164714 filed Sep. 10, 2019.

BACKGROUND

(i) Technical Field

The present disclosure relates to image forming apparatuses.

(ii) Related Art

An image forming apparatus disclosed in Japanese Unexamined Patent Application Publication No. 2003-302846 performs programmable transfer voltage control (PTVC) to set a transfer voltage and applies a constant voltage. In this system, when a voltage to be applied is to be set by detecting a transfer current at the leading edge of a transfer member and comparing the detected transfer current with a threshold value, this threshold value is changed by referring to sheet-feed-port information.

SUMMARY

In the image forming apparatus in the related art, the transfer member having received a voltage nips a revolving member, which retains a toner image thereon, and a recording medium, and transfers the toner image on the revolving member onto the recording medium.

In such an image forming apparatus, when the toner image retained by the revolving member is to be transferred onto the recording medium, the toner image is transferred onto the recording medium in accordance with constant voltage control. However, if the recording medium used is a low-resistance medium having a low surface resistance, a transfer defect may occur with the constant voltage control.

Aspects of non-limiting embodiments of the present disclosure relate to suppressing the occurrence of a transfer defect of a toner image onto a low-resistance medium, as compared with a case where a toner image is transferred onto a recording medium consistently in accordance with constant voltage control.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including a revolving member, a transfer member, a guide member, and a controller. The revolving member revolves and retains a toner image on a peripheral surface thereof. The transfer member nips a transported recording medium and the revolving member at a nipping section and transfers the toner image retained by the revolving member onto the recording medium by receiving a voltage. The guide member is connected to ground, guides the recording medium to the nipping section, and is in contact with the recording medium nipped at the nipping section. The controller performs constant current control to transfer the toner image onto the recording medium if a print resistance is lower than or equal to a system resistance. The print resistance corresponds to when the voltage is applied to the transfer member in a state where the recording medium is nipped at the nipping section. The system resistance corresponds to when the voltage is applied to the transfer member in a state where the recording medium is not nipped at the nipping section.

BRIEF DESCRIPTION OF THE DRAWINGS

Exemplary embodiments of the present disclosure will be described in detail based on the following figures, wherein.

DETAILED DESCRIPTION

First Exemplary Embodiment

An example of an image forming apparatus according to a first exemplary embodiment of the present disclosure will be described with reference to FIGS. 1 to 12. In each of the drawings, an arrow H indicates an up-down direction as a vertical direction of the apparatus, an arrow W indicates a width direction as a horizontal direction of the apparatus, and an arrow D indicates a depth direction as another horizontal direction of the apparatus.

Overall Configuration of Image Forming Apparatus

Figure 12:
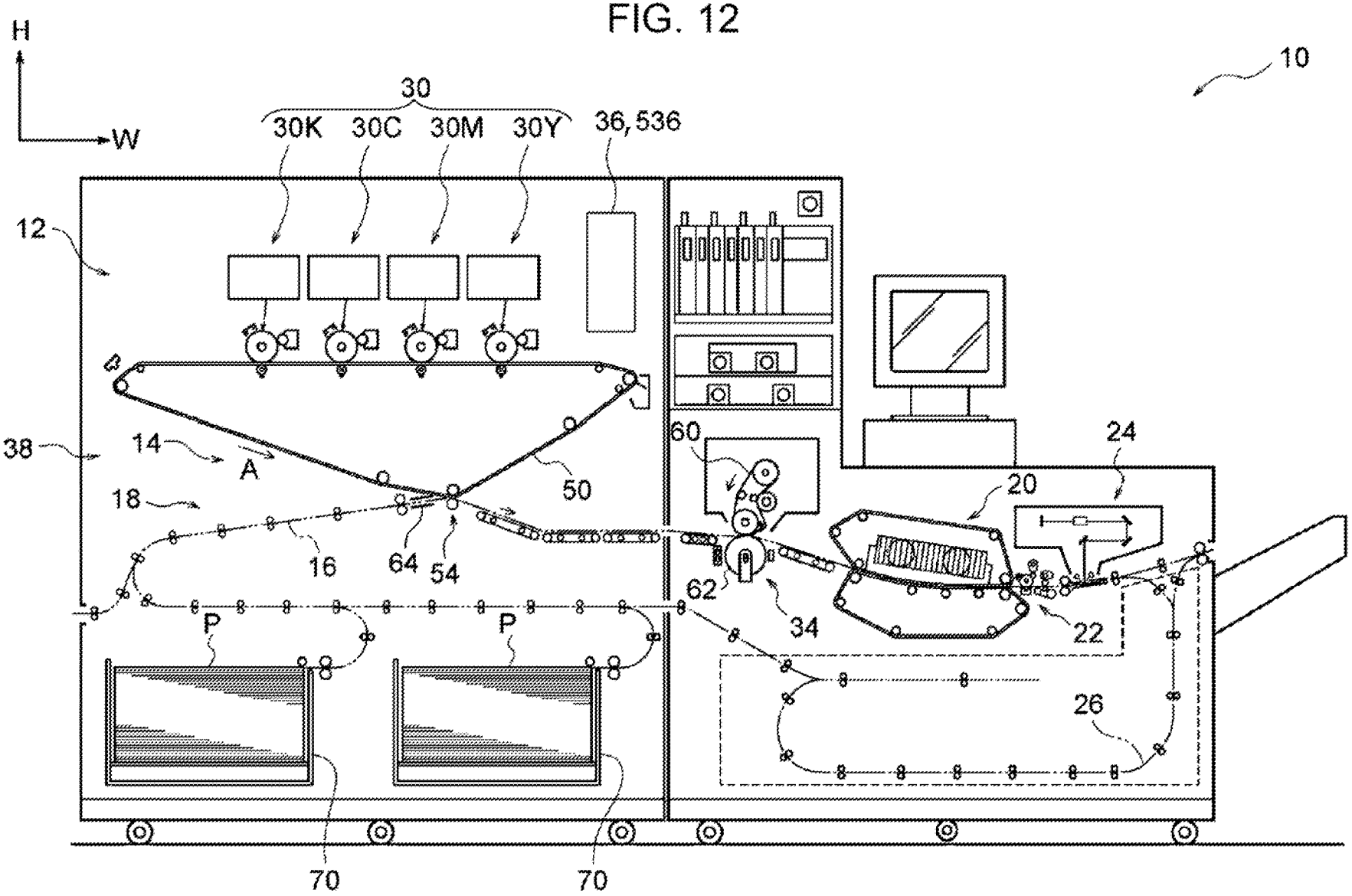
FIG. 12 is a configuration diagram schematically illustrating the image forming apparatus according to the first exemplary embodiment of the present disclosure.

As shown in FIG. 12, an image forming apparatus 10 includes an image forming unit 12 that forms an image by electrophotography, and also includes a transport device 18 having multiple transport rollers (not given reference signs) that transport a sheet member P (as an example of a recording medium) along a transport path 16 of the sheet member P.

Moreover, the image forming apparatus 10 includes a cooler 20 that cools the sheet member P having an image formed thereon, a corrector 22 that corrects bending of the sheet member P, an image inspector 24 that inspects the image formed on the sheet member P, and a controller 36 that controls each component. The image inspector 24, the controller 36, and the transport device 18 will be described in detail later.

Furthermore, for forming images on opposite faces of the sheet member P, the image forming apparatus 10 includes an inversion path 26 used for inverting the sheet member P having an image formed on the front face thereof and transporting the sheet member P toward the image forming unit 12 again.

In the image forming apparatus 10 having this configuration, an image (i.e., a toner image) formed by the image forming unit 12 is formed on the front face of the sheet member P transported along the transport path 16. Moreover, the sheet member P having the image formed thereon travels through the cooler 20, the corrector 22, and the image inspector 24 in this order so as to be output from the apparatus.

If an image is to be formed on the rear face of the sheet member P, the sheet member P having the image formed on the front face thereof is transported along the inversion path 26, so that an image is formed again on the rear face of the sheet member P by the image forming unit 12.

Image Forming Unit 12

The image forming unit 12 includes multiple toner-image forming units 30 that individually form toner images of respective colors, and also includes a transfer unit 14 that is provided with a transfer belt 50 for retaining the toner images thereon and that transfers the toner images onto the sheet member P. Furthermore, the image forming unit 12 includes a fixing device 34 that fixes the toner images transferred on the sheet member P by the transfer unit 14 onto the sheet member P. The transfer unit 14 will be described in detail later.

The multiple toner-image forming units 30 form toner images of respective colors. In this exemplary embodiment, there are four toner-image forming units 30 provided for yellow (Y), magenta (M), cyan (C), and black (K) colors. In FIG. 12, Y, M, C, and K denote the respective colors. In the following description, if the yellow (Y), magenta (M), cyan (C), and black (K) colors are not to be distinguished from one another, Y, M, C, and K added to the reference signs will be omitted.

Figure 10:
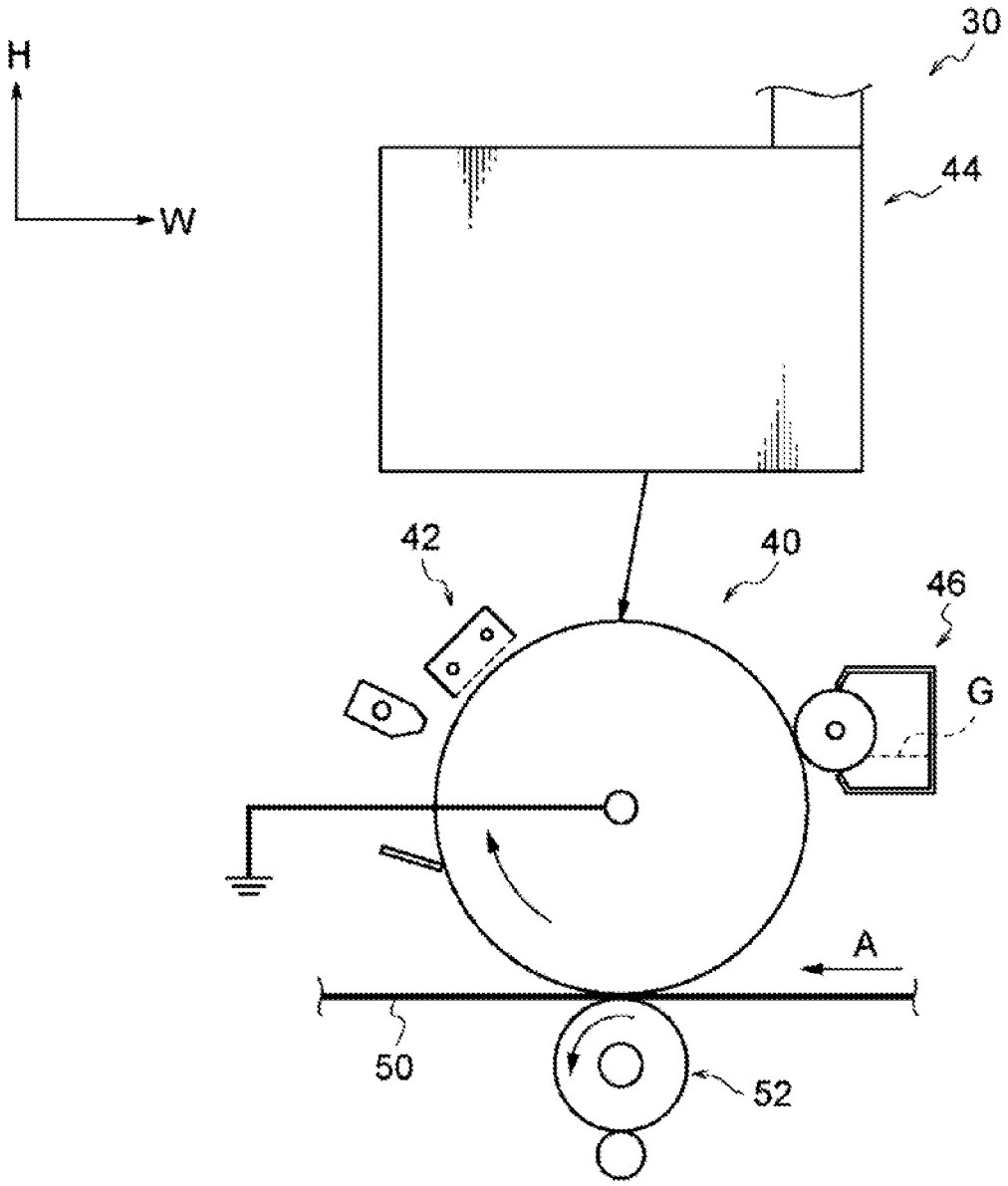
FIG. 10 is a configuration diagram illustrating a toner-image forming unit of the image forming apparatus according to the first exemplary embodiment of the present disclosure.

The toner-image forming units 30 for the respective colors basically have identical configurations except for the toners used, and each include a rotating cylindrical image bearing member 40 and a charger 42 that electrostatically charges the image bearing member 40, as shown in FIG. 10. Furthermore, each toner-image forming unit 30 includes an exposure device 44 that forms an electrostatic latent image by radiating exposure light onto the electrostatically-charged image bearing member 40, and also includes a developing device 46 that develops the electrostatic latent image into a toner image by using a developer G that contains a toner. The developer G used in this exemplary embodiment is a two-component developer containing a toner and a carrier.

The image bearing members 40 for the respective colors are connected to ground and are in contact with the transfer belt 50 (to be described in detail later) that moves in a revolving fashion. As shown in FIG. 12, the toner-image forming units 30 for the yellow (Y), magenta (M), cyan (C), and black (K) colors are arranged in the horizontal direction in this order from upstream in the revolving direction (indicated by an arrow A) of the transfer belt 50.

As shown in FIG. 12, the fixing device 34 includes a heated fixing belt 60 wrapped around multiple rollers (without reference signs) and a pressing roller 62 that presses the sheet member P toward the fixing belt 60.

In this configuration, the sheet member P having the toner images transferred thereon is nipped and transported by the revolving fixing belt 60 and the pressing roller 62, so that the toner images are fixed onto the sheet member P. Configuration of Relevant Components Next, the transfer unit 14, the image inspector 24, the transport device 18, and the controller 36 will be described.

Transfer Unit 14

Figure 11:
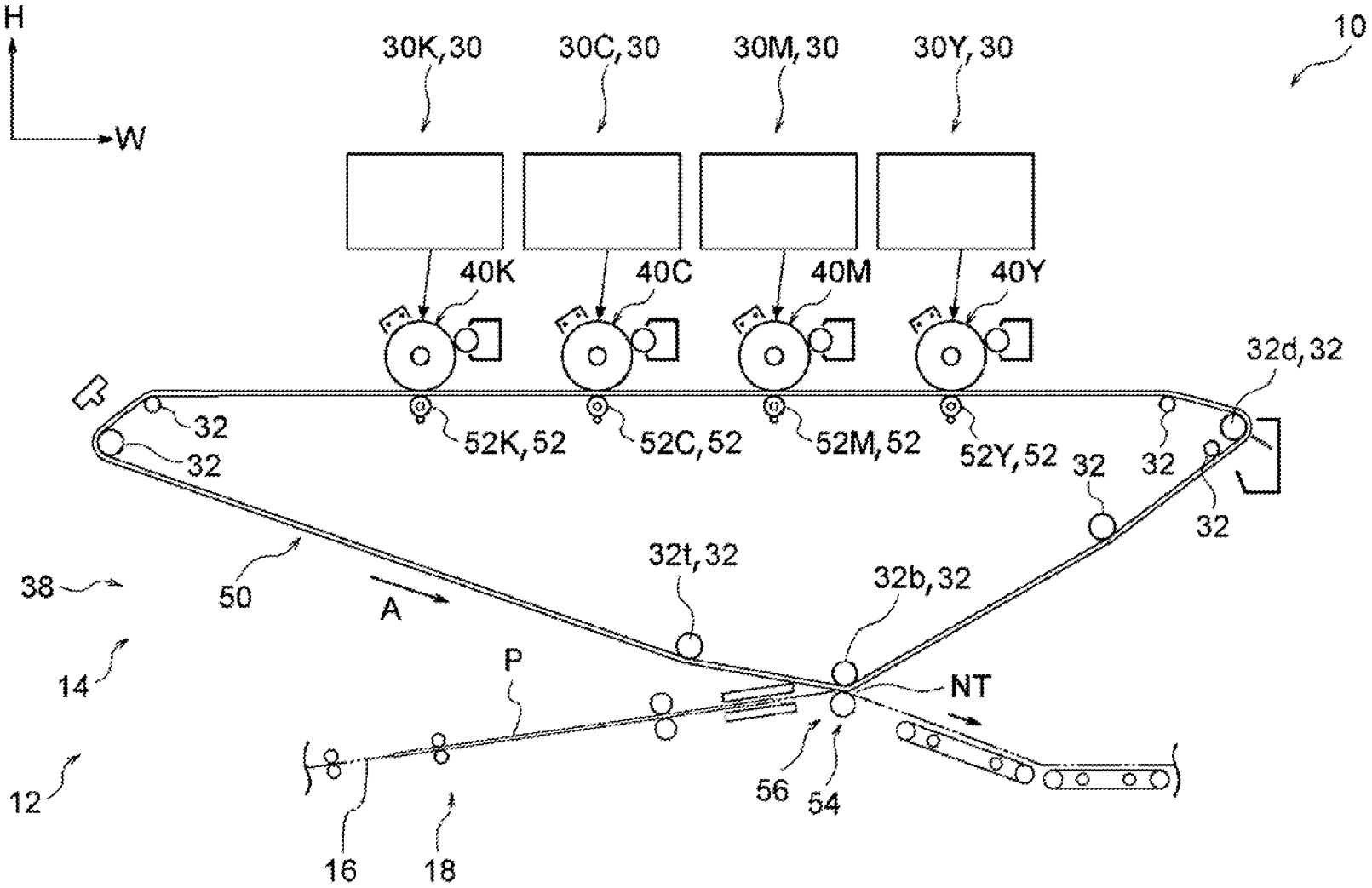
FIG. 11 is a configuration diagram illustrating an image forming unit of the image forming apparatus according to the first exemplary embodiment of the present disclosure.

As shown in FIG. 11, the transfer unit 14 includes the transfer belt 50, multiple rollers 32 around which the transfer belt 50 is wrapped, and first-transfer rollers 52 that transfer the toner images on the image bearing members 40 onto the transfer belt 50. Furthermore, the transfer unit 14 includes a second-transfer roller 54 that transfers the toner images transferred on the transfer belt 50 onto the sheet member P, and also includes a high-voltage power supply 68 (see FIG. 1). The transfer belt 50 is an example of a revolving member.

Transfer Belt 50

As shown in FIG. 11, the transfer belt 50 is endless and is wrapped around the multiple rollers 32. As viewed from the depth direction of the apparatus, the transfer belt 50 is positioned to have an inverted obtuse triangular shape that is long in the width direction of the apparatus. In this exemplary embodiment, the transfer belt 50 is composed of, for example, a material with carbon dispersed in polyimide. Moreover, the transfer belt 50 has a volume resistivity of 12.5 log Ωcm.

Rollers 32

As shown in FIG. 11, the multiple rollers 32 are provided. Among the multiple rollers 32, a roller 32*d* disposed at one side (i.e., the right side) in the width direction of the apparatus receives a rotational force from a motor (not shown) so as to cause the transfer belt 50 to revolve in the direction of the arrow A (i.e., counterclockwise direction).

Furthermore, the multiple rollers 32 include a roller 32*b* over which the obtuse lower apex of the transfer belt 50 positioned to have the obtuse triangular shape is looped. The roller 32*b* is disposed opposite the second-transfer roller 54, to be described later, with the transfer belt 50 interposed therebetween, and receives a voltage. In this exemplary embodiment, the roller 32*b* is, for example, an elastic roller having an outer diameter of 28 mm. Furthermore, the roller 32*b* has a surface resistance of 7.3 log Ω/sq. The roller 32*b* has a surface hardness, that is, an Asker C hardness, of 53 degrees.

Among the multiple rollers 32, a roller 32*t* disposed next to the roller 32*b* at the upstream side thereof in the revolving direction of the transfer belt 50 (referred to as "belt revolving direction" hereinafter) applies tension to the transfer belt 50.

First-Transfer Rollers 52

As shown in FIG. 11, the first-transfer rollers 52 are disposed opposite the image bearing members 40 of the respective colors with the transfer belt 50 interposed therebetween.

In this configuration, a transfer current flows to each first-transfer roller 52 so that a transfer electric field is generated between the first-transfer roller 52 and the image bearing member 40. This transfer electric field causes the toner image on each image bearing member 40 to be transferred onto the transfer belt 50.

Second-Transfer Roller 54

Figure 1:
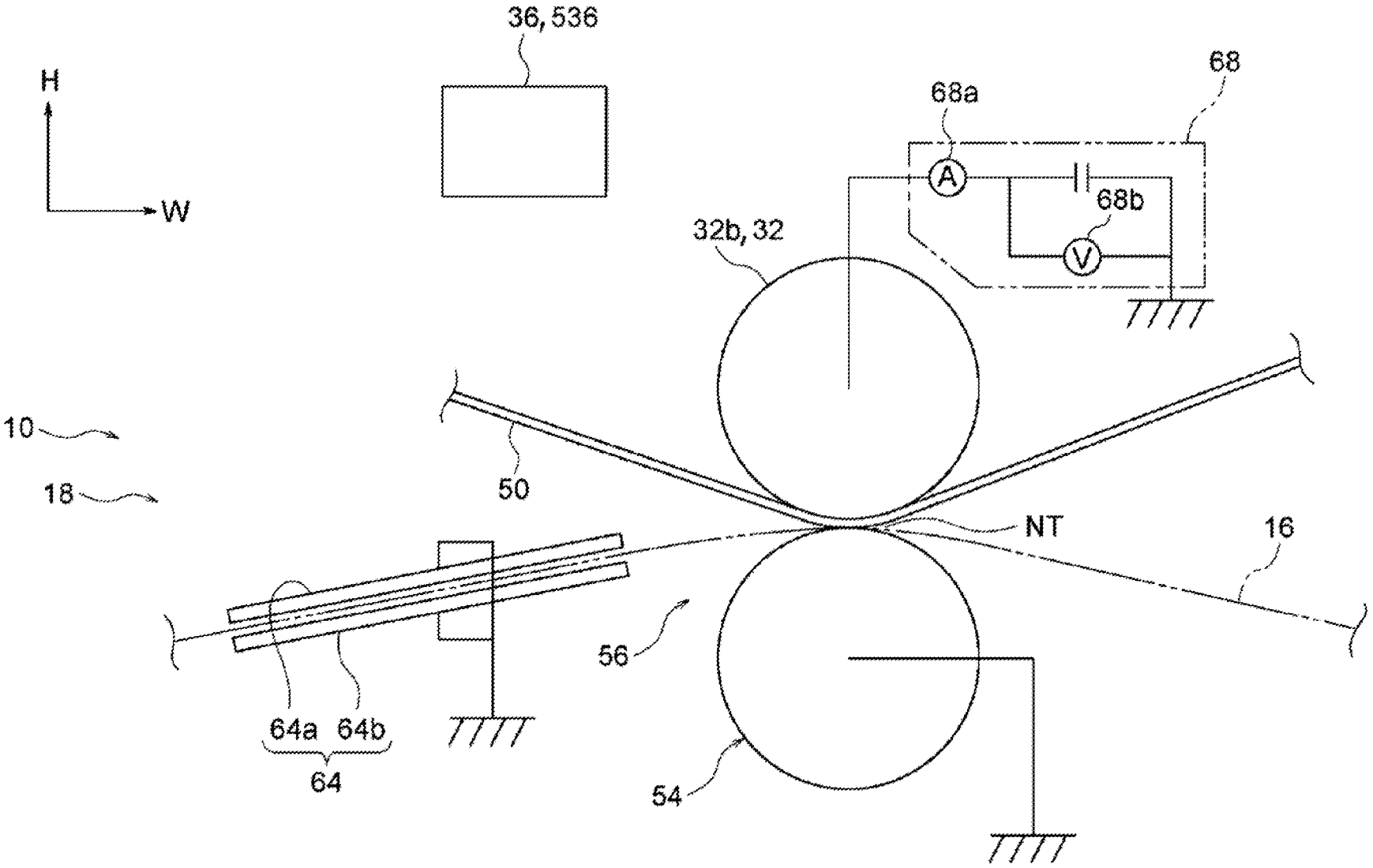
FIG. 1 is a side view illustrating a transfer member and other components included in an image forming apparatus according to a first exemplary embodiment of the present disclosure.

As shown in FIG. 1, the second-transfer roller 54 is connected to ground and nips the transfer belt 50 together with the roller 32*b*. In this exemplary embodiment, the second-transfer roller 54 is, for example, an elastic roller having an outer diameter of 28 mm. Furthermore, the second-transfer roller 54 has a resistance of 6.3 log Ω.

High-Voltage Power Supply 68

The high-voltage power supply 68 has a function of applying a direct-current voltage to the roller 32*b* so as to apply an electric current thereto. As shown in FIG. 1, the high-voltage power supply 68 has an ammeter 68*a* that may monitor an electric current flowing through the roller 32*b*, and also has a voltmeter 68*b* that may monitor a voltage applied to the roller 32*b*.

In this configuration, the sheet member P transported while being nipped at a second-transfer section NT between the transfer belt 50 and the second-transfer roller 54 is pressed toward the transfer belt 50. Then, a voltage is applied to the roller 32*b*, so that an electric current flows between the roller 32*b* and the second-transfer roller 54, whereby a transfer electric field is generated. This transfer electric field causes a toner image retained by the transfer belt 50 to be transferred onto the transported sheet member P at the second-transfer section NT. The second-transfer section NT is an example of a nipping section.

Accordingly, the second-transfer roller 54 and the roller 32*b* constitute a transfer member 56 that nips the transported sheet member P and the transfer belt 50 and that transfers the toner image retained by the transfer belt 50 onto the sheet member P.

Image Inspector 24

As shown in FIG. 12, the image inspector 24 is disposed downstream of the fixing device 34 in the transport direction of the sheet member P (referred to as "sheet transport direction" hereinafter). The image inspector 24 radiates light toward the sheet member P having the toner image formed thereon, receives the reflected light, and detects the density of the toner image (toner image density) based on the intensity of the received light. The image inspector 24 is an example of a detection member.

Transport Device 18

As shown in FIG. 12, the transport device 18 includes containers 70 containing sheet members P therein, multiple transport rollers (not given reference signs) that transport each of the sheet members P contained in the containers 70 along the transport path 16, and a guide member 64 that guides each transported sheet member P toward the second-transfer section NT.

Figure 2:
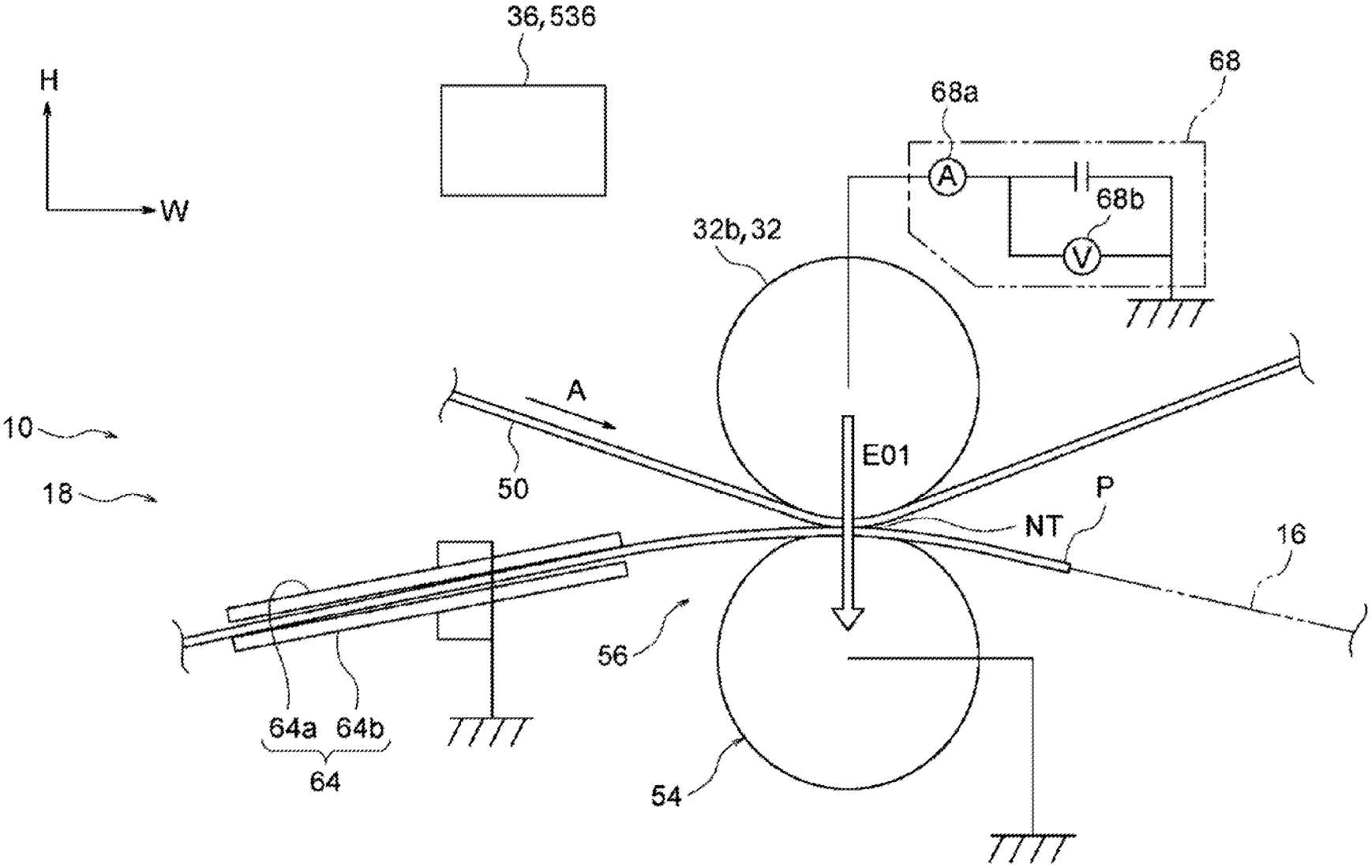
FIG. 2 is a side view illustrating the transfer member and other components included in the image forming apparatus according to the first exemplary embodiment of the present disclosure.

As shown in FIG. 1, the guide member 64 is connected to ground and is disposed in contact with the sheet member P whose leading edge is nipped at the second-transfer section NT at the upstream side of the second-transfer section NT in the sheet transport direction (see FIG. 2). In detail, the sheet member P being transported curves so that the guide member 64 comes into contact with the sheet member P. The guide member 64 is composed of a conductive material and includes a tabular guide plate 64*a* that covers the sheet member P from above and a tabular guide plate 64*b* that supports the sheet member P from below. Accordingly, the guide member 64 functions as a charge remover that removes an electric charge from the sheet member P. The conductive material has an electrical conductivity of $10^6$ S/m or higher.

Miscellaneous Components

Figure 6:
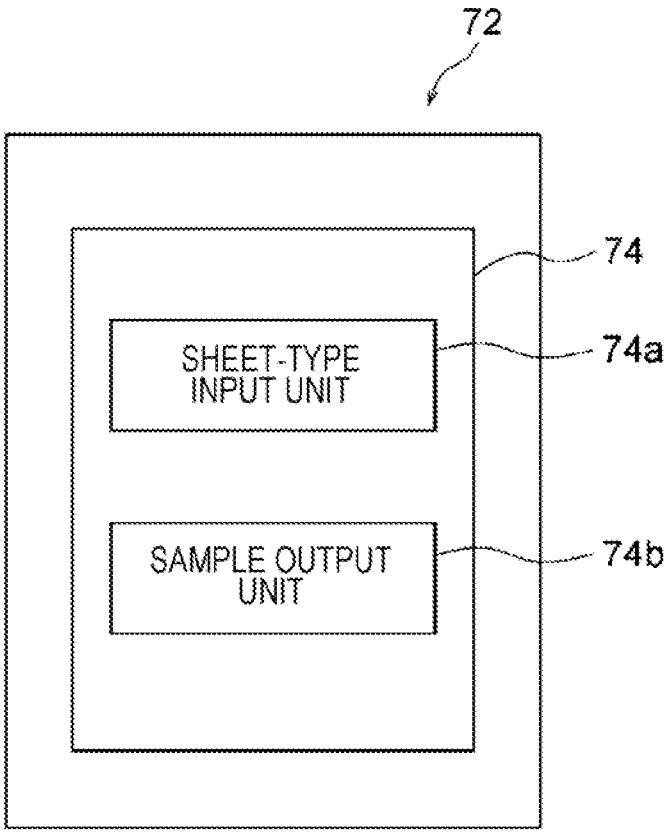
FIG. 6 illustrates the configuration of a part of a user interface of the image forming apparatus according to the first exemplary embodiment of the present disclosure.

As shown in FIG. 6, a user interface 72 of the image forming apparatus 10 is provided with an input unit 74 to which information about the sheet members P contained in the containers 70 (see FIG. 12) is input.

The input unit 74 is provided with a sheet-type input unit 74*a* to which the sheet type of sheet members P contained in each container 70 is input and a sample output unit 74*b* that outputs a toner image of a sample pattern to a sheet member P contained in one of the containers 70. When the user touches the sample output unit 74*b*, the toner image of the sample pattern is formed on the sheet member P contained in the container 70, and control of the high-voltage power supply 68 by the controller 36 is set. This will be described in detail later.

Controller 36

Figure 8:
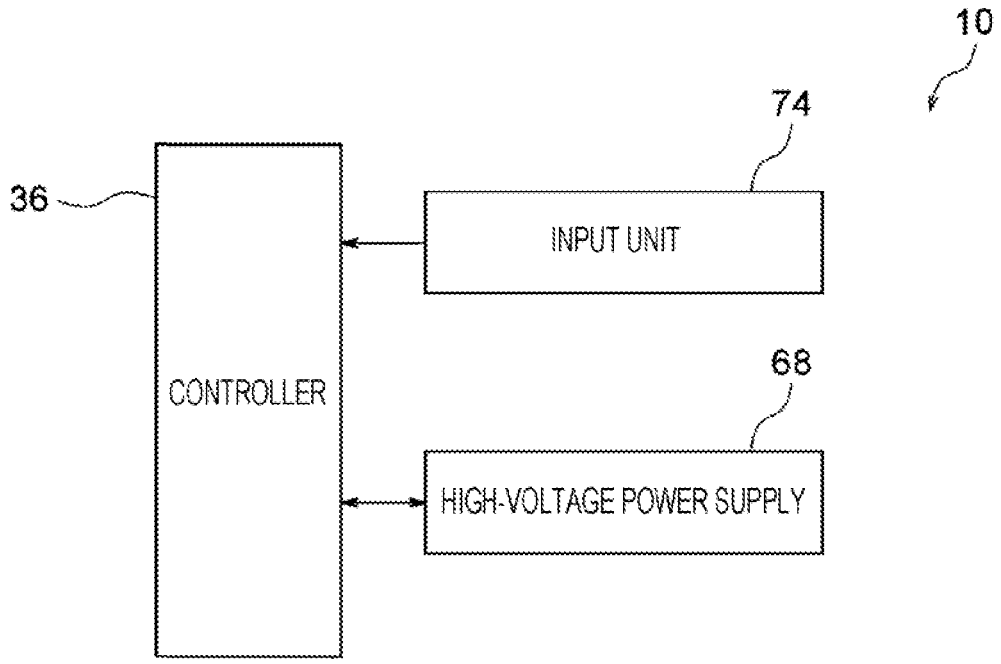
FIG. 8 is a block diagram illustrating a control system of the controller of the image forming apparatus according to the first exemplary embodiment of the present disclosure.

As shown in FIG. 8, the controller 36 controls the high-voltage power supply 68 based on information input to the input unit 74 by the user. The control of the high-voltage power supply 68 by the controller 36 will be described later together with the operation.

Operation of Relevant Components

Next, the operation of the relevant components will be described while being compared with an image forming apparatus 510 according to a comparative example. With regard to the configuration and the operation of the image forming apparatus 510 according to the comparative example, features different from those of the image forming apparatus 10 will be described.

Configuration of Image Forming Apparatus 510

Figure 13:
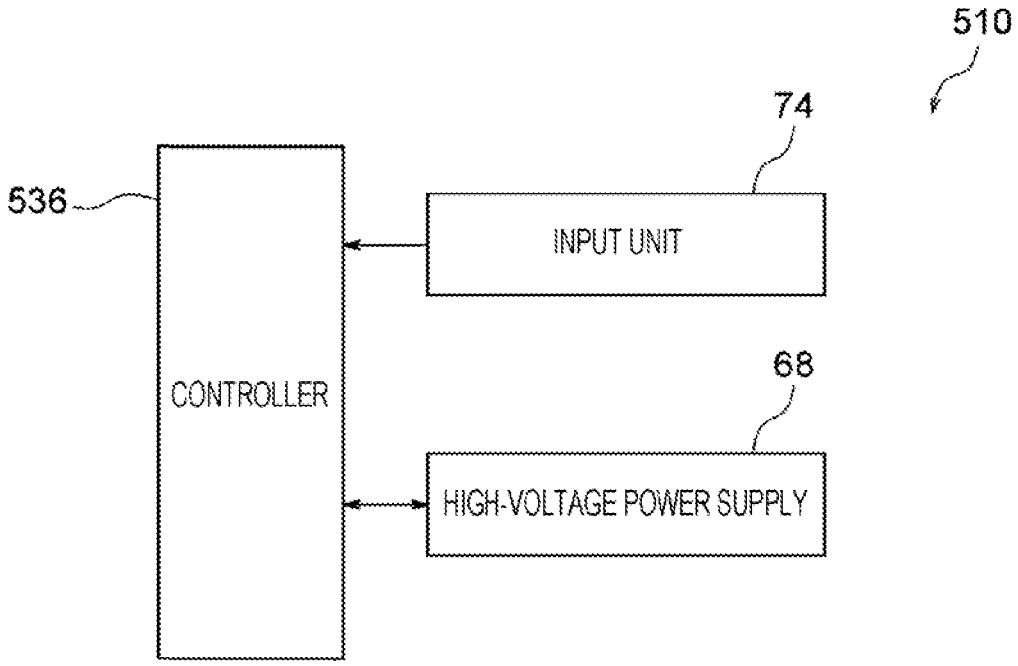
FIG. 13 is a block diagram illustrating a control system of a controller of an image forming apparatus according to a comparative example relative to the first exemplary embodiment of the present disclosure.

As shown in FIG. 13, the image forming apparatus 510 includes a controller 536. The controller 536 controls the high-voltage power supply 68.

Operation of Image Forming Apparatuses 10 and 510

In a state where the power of the image forming apparatus 10 shown in FIG. 12 is turned off, all components are stopped. When the user turns on the power of the image forming apparatus 10, the controller 36 or 536 shown in FIG. 1 controls the high-voltage power supply 68 so as to cause an electric current of a predetermined current value to flow to the roller 32*b*. Moreover, the controller 36 or 536 acquires a voltage from the voltmeter 68*b* when the electric current flows through the roller 32*b*, and calculates a system resistance from the electric current flowing through the roller 32*b* and the voltage acquired from the voltmeter 68*b*.

A "system resistance" is a combined resistance of the roller 32*b*, the transfer belt 50, and the second-transfer roller 54 when an electric current used for transferring a toner image onto a sheet member P flows through the roller 32*b* in a state where the sheet member P is not nipped at the second-transfer section NT.

Controller 536 in Image Forming Apparatus 510

In a case where a toner image is to be transferred onto a sheet member P, the controller 536 included in the image forming apparatus 510 according to the comparative example applies a voltage of a predetermined value to the roller 32*b* based on the aforementioned system resistance and sheet-type information input to the sheet-type input unit 74*a* by the user. Then, the controller 536 consistently performs constant voltage control to transfer the toner image onto the sheet member P.

In detail, the controller 536 sets a voltage to be applied to the roller 32*b* by using a print resistance in a state where plain paper as a sheet member P is nipped at the second-transfer section NT. The print resistance is set in accordance with sheet-type information preliminarily stored in the image forming apparatus 510 and sheet-type information input to the sheet-type input unit 74*a*.

"Constant voltage control" involves performing control to match an output voltage value with a target voltage value. "Plain paper" is a recording medium normally used in image forming apparatuses and has a surface resistivity (JIS K 6911) greater than $10^6$ Ω/sq. A "print resistance" is a combined resistance of the roller 32*b*, the transfer belt 50, the second-transfer roller 54, the sheet member P, and the guide member 64 when an electric current used for transferring a toner image onto a sheet member P flows to the roller 32*b* in a state where the sheet member P is nipped at the second-transfer section NT.

Figure 9:
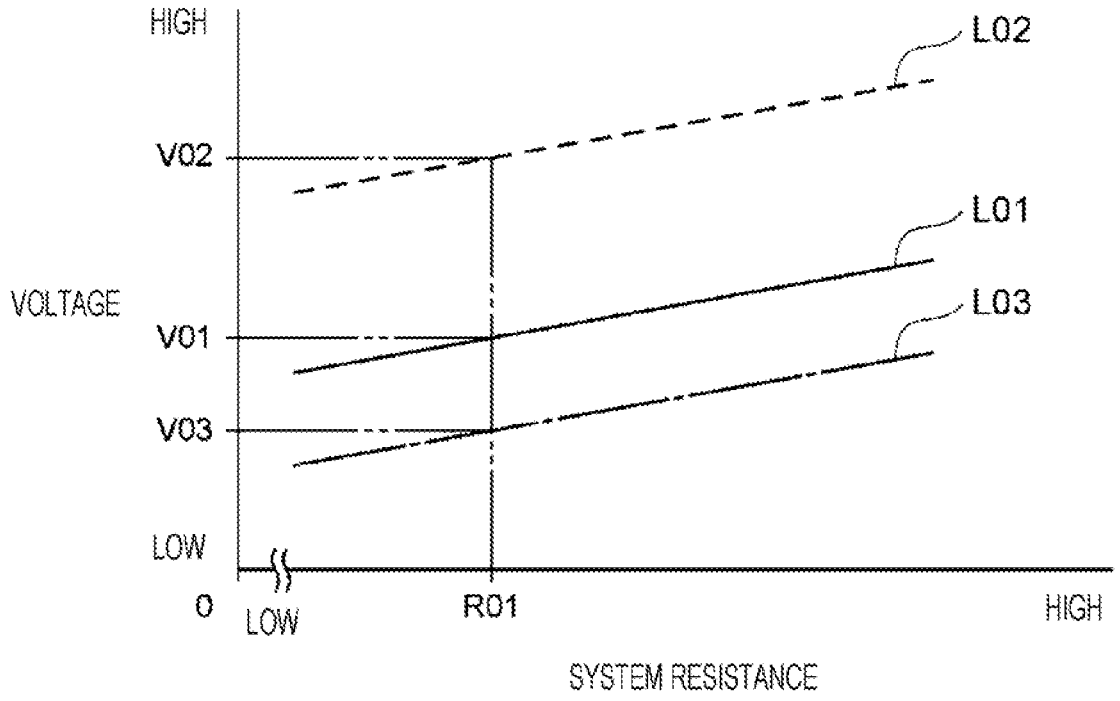
FIG. 9 is a graph illustrating a voltage used for transferring a toner image onto a sheet member for each sheet type, in the image forming apparatus according to the first exemplary embodiment of the present disclosure.

FIG. 9 illustrates a graph having an ordinate axis indicating a voltage applied to the roller 32*b* when an electric current used for transferring a toner image onto a sheet member P flows to the roller 32*b* and an abscissa axis indicating a system resistance. A solid line L01 indicates a voltage when the sheet member P is not nipped at the second-transfer section NT, and a dashed line L02 indicates a voltage when plain paper as the sheet member P is nipped at the second-transfer section NT.

As shown in FIG. 2, when a voltage is applied to the roller 32*b* in a state where plain paper as the sheet member P is nipped at the second-transfer section NT, the electric current flows toward the second-transfer roller 54 from the roller 32*b* (see an arrow E01 in FIG. 2). Thus, the print resistance when the plain paper as the sheet member P is nipped at the second-transfer section NT becomes higher than the system resistance.

It is clear from the graph shown in FIG. 9 that, when a toner image is to be transferred onto the plain paper as the sheet member P (see the dashed line L02), a high voltage has to be applied to the roller 32*b*, as compared with a case where the sheet member P is not nipped at the second-transfer section NT (see the solid line L01).

For example, in a case where the system resistance is R01, a voltage to be applied to the roller 32*b* is V01 when an electric current used for transferring the toner image onto the sheet member P flows to the roller 32*b* in a state where the sheet member P is not nipped at the second-transfer section NT. Furthermore, in a case where the system resistance is R01, a voltage to be applied to the roller 32*b* is V02 when an electric current used for transferring the toner image onto the sheet member P flows to the roller 32*b* in a state where plain paper as the sheet member P is nipped at the second-transfer section NT. The voltage V02 is higher than the voltage V01.

Accordingly, in the image forming apparatus 510, the roller 32*b* receives a voltage higher than the voltage applied to the roller 32*b* when an electric current used for transferring the toner image onto the sheet member P flows to the roller 32*b* in a state where the sheet member P is not nipped at the second-transfer section NT.

The electric current flows between the roller 32*b* and the second-transfer roller 54 in accordance with the applied voltage, so that a transfer electric field is generated. This transfer electric field causes the toner image retained by the transfer belt 50 to be transferred onto the sheet member P. Accordingly, in the image forming apparatus 510, a toner image is transferred onto a sheet member P consistently in accordance with constant voltage control.

Figure 5:
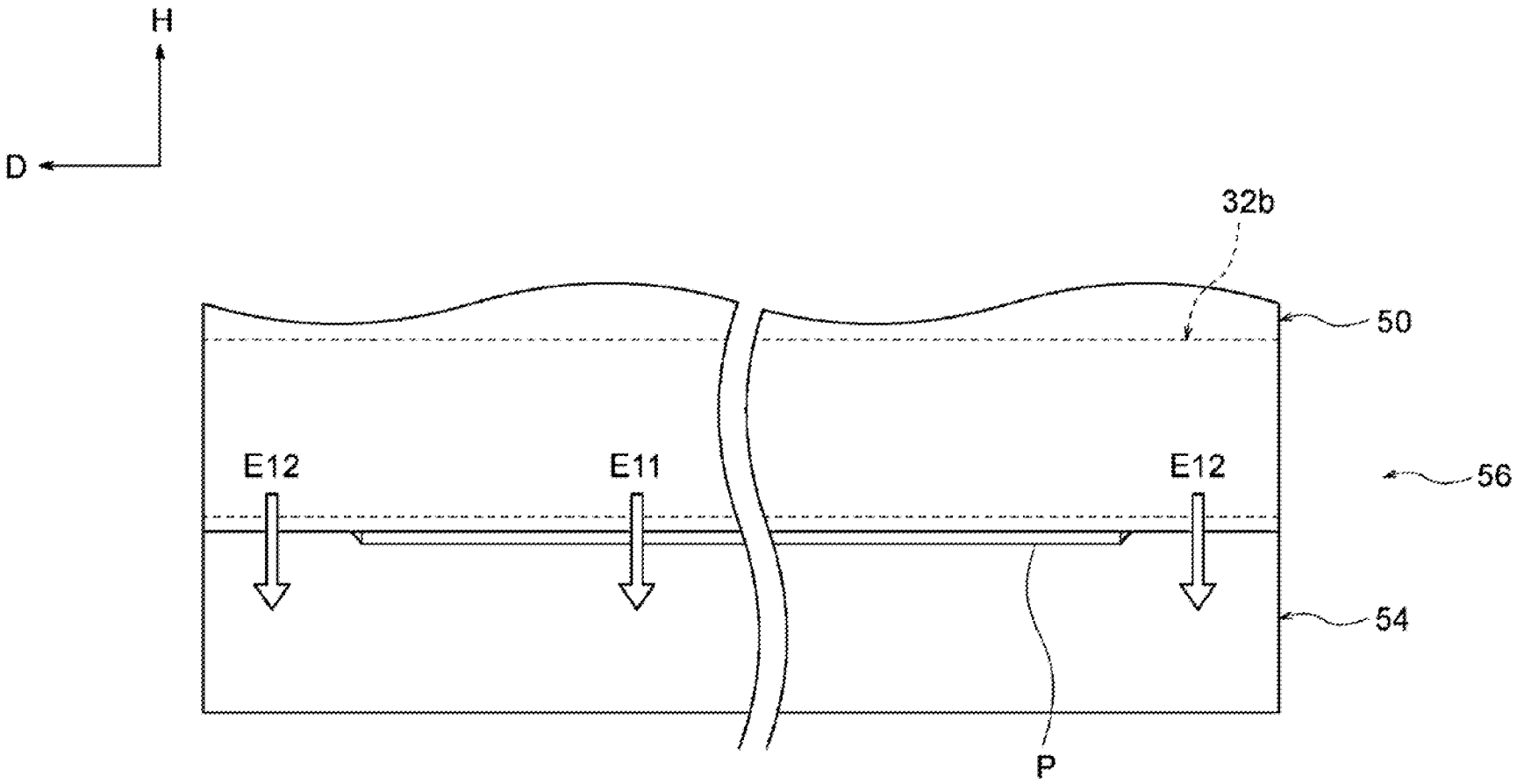
FIG. 5 is a front view illustrating the transfer member and other components included in the image forming apparatus according to the first exemplary embodiment of the present disclosure.

The reason for performing the constant voltage control will be described here. FIG. 5 illustrates an electric current flowing from the roller 32*b* toward the second-transfer roller 54 when a voltage is applied to the roller 32*b* in a state where plain paper as a sheet member P is nipped at the second-transfer section NT. However, the electric current value varies between an electric current (see an arrow E11 in FIG. 5) flowing to an area where the sheet member P is nipped and an electric current (see arrows E12 in FIG. 5) flowing to areas where the sheet member P is not nipped. Therefore, it is difficult to control the electric current value of the electric current E11 flowing to the area where the sheet member P is nipped. The controller 536 included in the image forming apparatus 510 transfers the toner image onto the sheet member P consistently in accordance with constant voltage control.

The following description relates to a case where a low-resistance medium is used as a sheet member P. A "low-resistance medium" is a recording medium that has a surface resistivity lower than that of plain paper and that has a surface resistivity (JIS K 6911) lower than or equal to $10^6$ Ω/sq, such as metallized paper having metal deposited on its surface or black paper given black color by a pigment.

Figure 3:
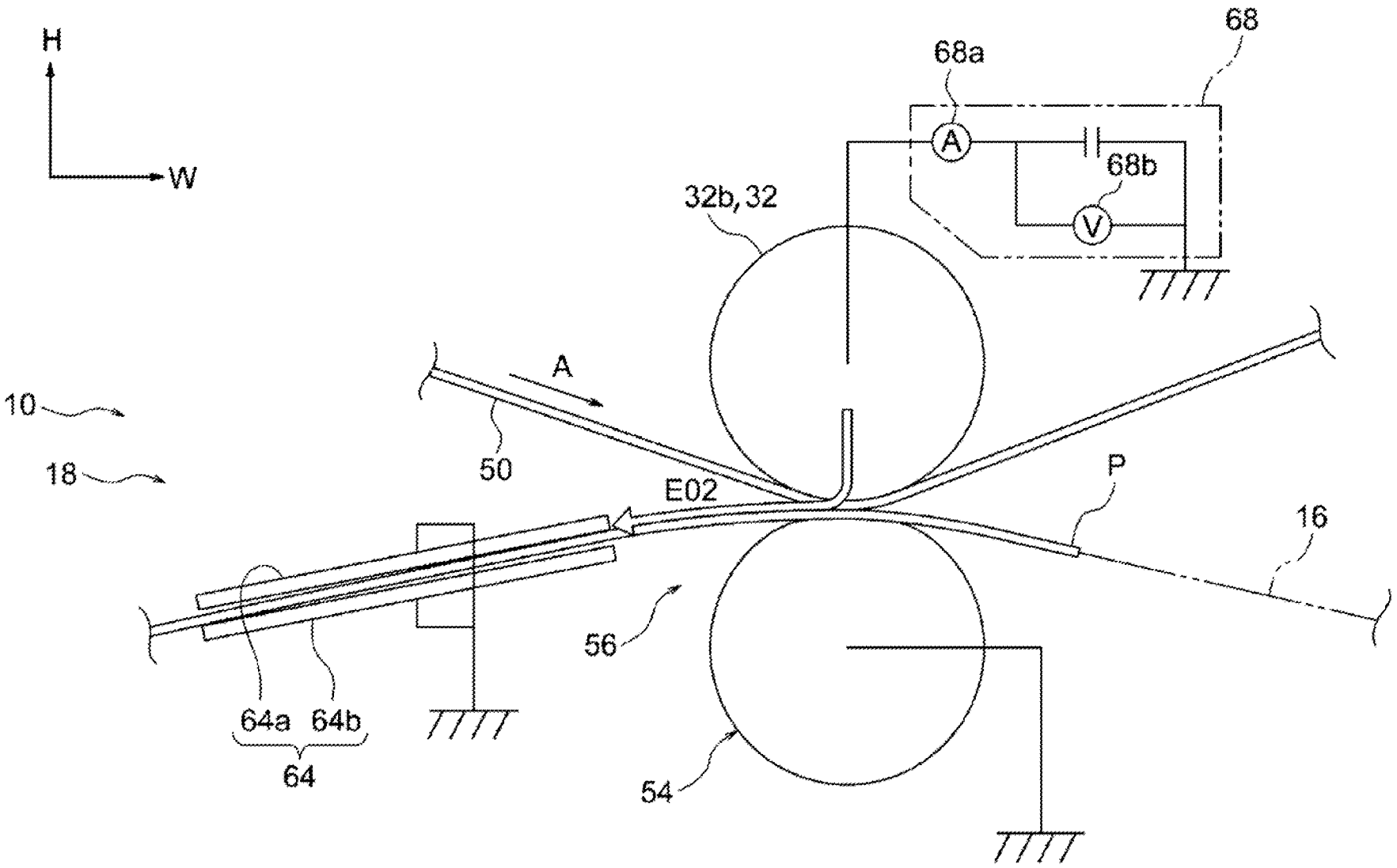
FIG. 3 is a side view illustrating the transfer member and other components included in the image forming apparatus according to the first exemplary embodiment of the present disclosure.

As shown in FIG. 3, when a voltage is applied to the roller 32*b* in a state where a low-resistance medium as a sheet member P is nipped at the second-transfer section NT, because the surface resistivity of the sheet member P is low, the electric current flows from the roller 32*b* to the sheet member P and then toward the guide member 64 composed of a conductive material (see an arrow E02 in FIG. 3).

Figure 4:
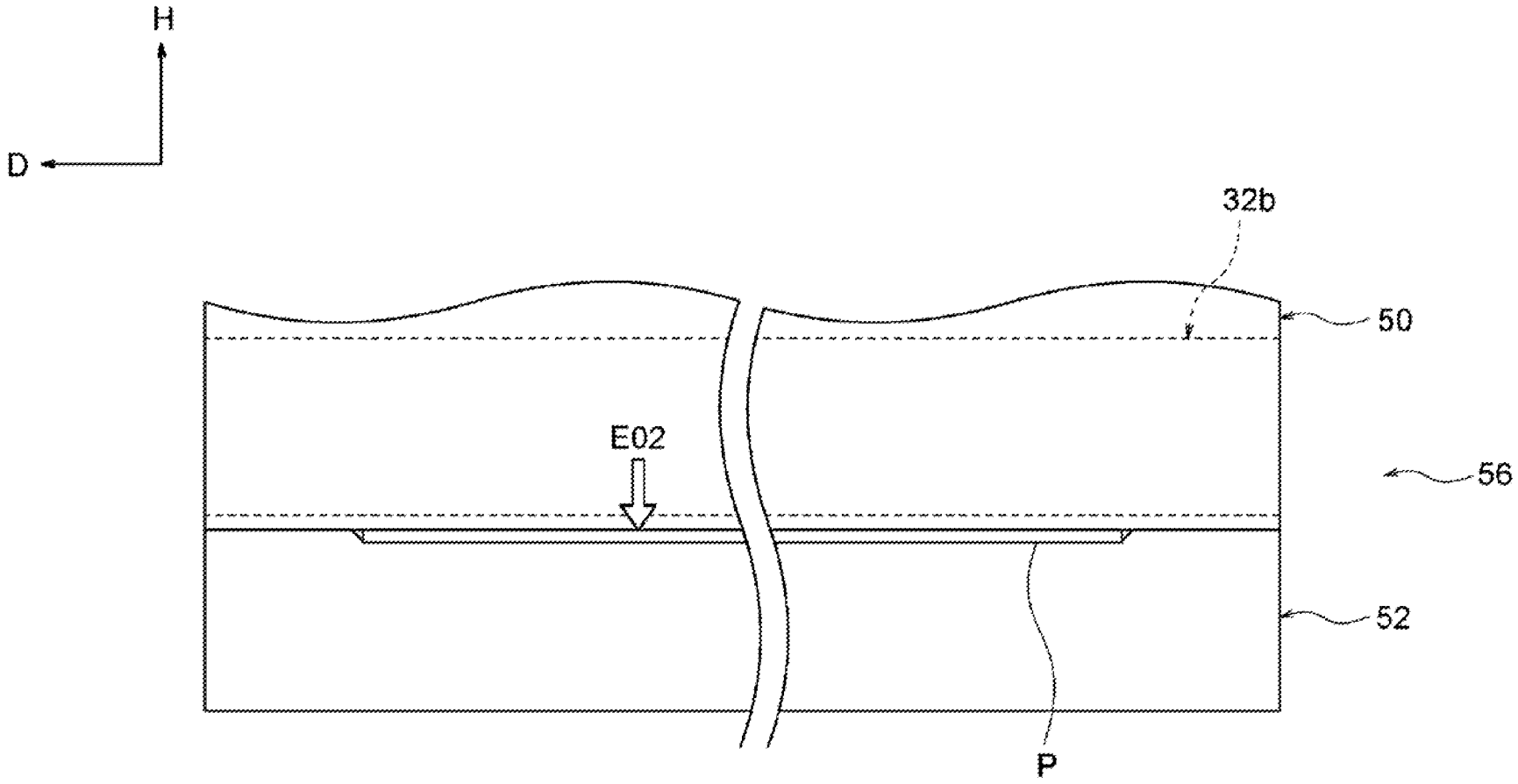
FIG. 4 is a front view illustrating the transfer member and other components included in the image forming apparatus according to the first exemplary embodiment of the present disclosure.

Therefore, as shown in FIG. 4, the electric current does not flow through areas where the sheet member P is not nipped. The electric current flows from the roller 32*b* to the sheet member P and then toward the guide member 64. Thus, in a state where the low-resistance medium as the sheet member P is nipped at the second-transfer section NT, the print resistance becomes equal to or lower than the system resistance. Accordingly, the guide member 64 functions as a controller that controls the direction of the flow of the electric current such that the electric current flows along the sheet surface of the sheet member P.

A single-dot chain line L03 in the graph in FIG. 9 indicates a voltage applied to the roller 32*b* when an electric current used for transferring a toner image onto a sheet member P flows to the roller 32*b* in a state where a low-resistance medium as a sheet member P is nipped at the second-transfer section NT. As mentioned above, in a state where the low-resistance medium is nipped at the second-transfer section NT, the print resistance is equal to or lower than the system resistance. Therefore, in a case where the toner image is to be transferred onto the low-resistance medium (i.e., the case of the single-dot chain line), it is clear from the graph in FIG. 9 that a low voltage has to be applied to the roller 32*b*, as compared with a case where the sheet member P is not nipped at the second-transfer section NT (see the solid line L01). The single-dot chain line L03 shown in FIG. 9 corresponds to a low-resistance medium with a surface resistivity of $10^3$ Ω/sq.

For example, in a case where the system resistance is R01, a voltage to be applied to the roller 32*b* is V03 when an electric current used for transferring a toner image onto a sheet member P flows to the roller 32*b* in a state where the low-resistance medium as the sheet member P is nipped at the second-transfer section NT.

However, in the image forming apparatus 510 according to the comparative example, the toner image is transferred onto the sheet member P consistently in accordance with constant voltage control. In the image forming apparatus 510, a high voltage is consistently applied to the roller 32*b*, as compared with a case where the sheet member P is not nipped at the second-transfer section NT (see the solid line L01).

Therefore, in the case where the low-resistance medium is used as the sheet member P in the image forming apparatus 510, the toner transferability decreases, possibly causing a transfer defect to occur when the toner image is transferred onto the sheet member P.

Controller 36 in Image Forming Apparatus 10

Figure 7:
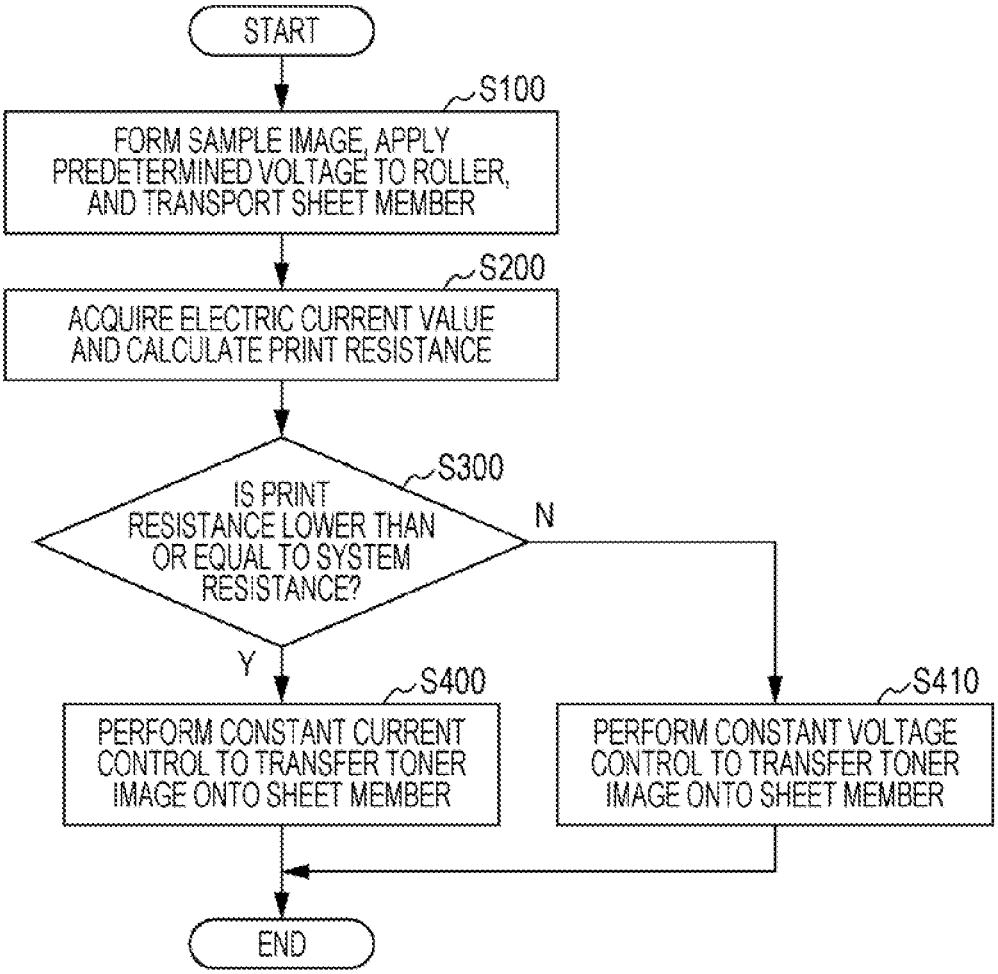
FIG. 7 is a flowchart illustrating the flow of control of each component by a controller of the image forming apparatus according to the first exemplary embodiment of the present disclosure.

Next, the operation performed on the high-voltage power supply 68 by the controller 36 included in the image forming apparatus 10 according to this exemplary embodiment will be described with reference to a flowchart shown in FIG. 7.

The user sets a sheet member P in one of the containers 70 and inputs sheet-type information about the set sheet member P to the sheet-type input unit 74*a* of the input unit 74. Moreover, in order to output a sample image as a black-color toner image, the user touches the sample output unit 74*b* of the input unit 74. This causes the controller 36 to revolve the transfer belt 50 and to control the toner-image forming unit 30K and the first-transfer roller 52K, so as to transfer the sample image onto the transfer belt 50 in step S100 in FIG. 7. Furthermore, the controller 36 controls the high-voltage power supply 68 so as to apply a predetermined voltage to the roller 32*b*. Moreover, the controller 36 controls the transport device 18 so as to transport the sheet member P contained in the container 70 along the transport path 16.

In step S200, the controller 36 causes the sample image to be transferred onto the sheet member P at the second-transfer section NT, and acquires, from the ammeter 68*a*, the electric current value of the electric current flowing when the sheet member P is nipped at the second-transfer section NT. Moreover, the controller 36 calculates a print resistance from the acquired electric current value and the voltage value of the voltage applied to the roller 32*b*.

In step S300, the controller 36 determines whether or not the acquired print resistance is lower than or equal to the system resistance. If the print resistance is lower than or equal to the system resistance, it is determined that the sheet member P is a low-resistance medium, and the process proceeds to step S400. If the print resistance is higher than the system resistance, it is determined that the sheet member P is plain paper, and the process proceeds to step S410. Accordingly, the controller 36 functions as a determining unit that determines whether the sheet member P nipped at the second-transfer section NT is a low-resistance medium or plain paper.

In step S400, if a toner image is to be transferred onto the sheet member P determined as being a low-resistance medium, the controller 36 controls the high-voltage power supply 68 such that a predetermined electric current flows to the roller 32*b*. Specifically, the controller 36 performs constant current control to transfer the toner image onto the sheet member P. In other words, the controller 36 controls the voltage to be applied to the roller 32*b* such that the electric current becomes equal to a predetermined electric current value. The electric current value is an electric current value used for transferring the toner image onto the sheet member P. In this exemplary embodiment, the electric current value is for a low-resistance medium and is preliminarily stored in the image forming apparatus 10. "Constant current control" involves matching an output electric current value with a target electric current value.

As mentioned above, since the surface resistivity of a low-resistance medium is low, an electric current does not flow to areas where the sheet member P is not nipped. Most of the electric current flows from the roller 32*b* to the sheet member P and then toward the guide member 64. Specifically, the transfer electric field where the toner image is transferred onto the sheet member P is generated by most of the flowing electric current. Therefore, in the case of a low-resistance medium, constant current control is possible. Accordingly, the sequential operation ends.

In contrast, when the process proceeds to step S410 as a result of the print resistance being higher than the system resistance, the controller 36 applies a voltage of a predetermined value to the roller 32*b* based on sheet-type information input to the sheet-type input unit 74*a* by the user. In detail, the controller 36 applies a high voltage to the roller 32*b*, as compared with a case where the sheet member P is not nipped at the second-transfer section NT. The controller 36 performs constant voltage control in this manner to transfer the toner image onto the sheet member P. Accordingly, the sequential operation ends.

Conclusion

As described above, in the image forming apparatus 10, if the print resistance is lower than or equal to the system resistance, the controller 36 determines that the sheet member P is a low-resistance medium, and performs constant current control to transfer the toner image onto the sheet member P. In detail, the controller 36 causes an electric current used for transferring the toner image onto the sheet member P to flow to the roller 32*b*. Therefore, the occurrence of a transfer defect of a toner image onto a low-resistance medium may be suppressed, as compared with the case of the image forming apparatus 510 that transfers a toner image onto a sheet member P consistently in accordance with constant voltage control.

Furthermore, in the image forming apparatus 10, if the print resistance is higher than the system resistance, the controller 36 determines that the sheet member P is plain paper, and performs constant voltage control to transfer the toner image onto the sheet member P. Therefore, the occurrence of a transfer defect of a toner image onto plain paper may be suppressed, as compared with a case where a toner image is transferred onto plain paper in accordance with constant current control.

Moreover, in the image forming apparatus 10, when the sheet member P is nipped at the second-transfer section NT, the controller 36 calculates the print resistance from the voltage applied to the roller 32*b* and the electric current flowing when the voltage is applied. Therefore, the print resistance may be readily calculated, as compared with a case where the print resistance is calculated by using the surface resistivity of the sheet member P.

Second Exemplary Embodiment

Figure 14:
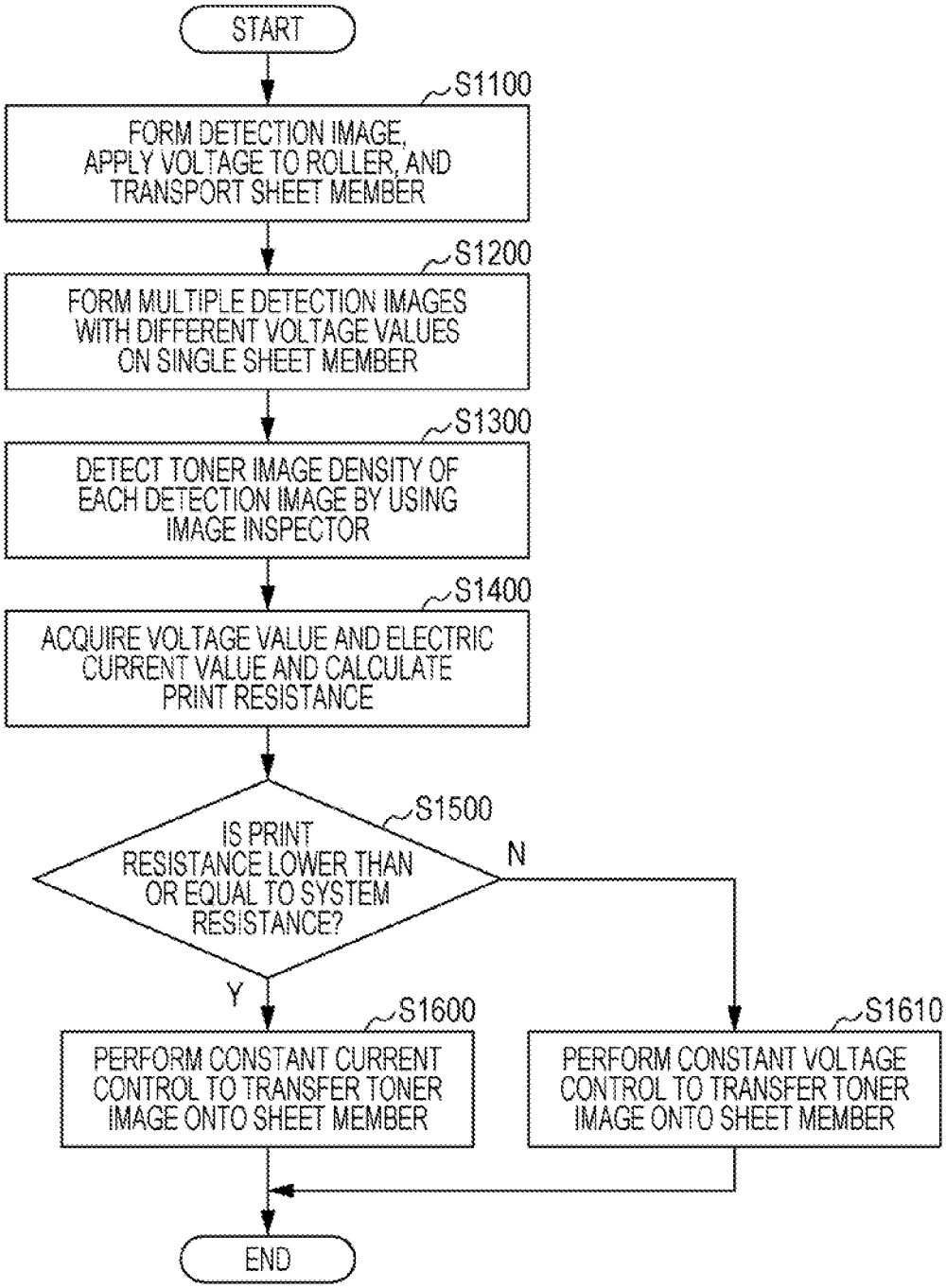
FIG. 14 is a flowchart illustrating the flow of control of each component by a controller of an image forming apparatus according to a second exemplary embodiment of the present disclosure.

An example of an image forming apparatus according to a second exemplary embodiment of the present disclosure will be described below with reference to FIGS. 14 to 16. In the second exemplary embodiment, features different from those in the first exemplary embodiment will be described.

Figure 15:
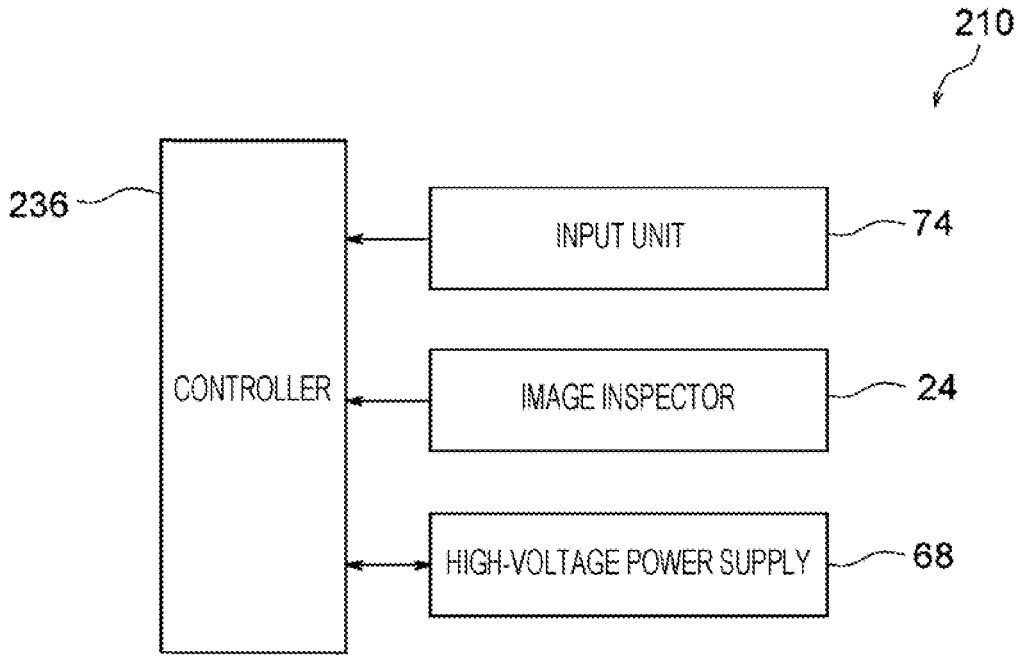
FIG. 15 is a block diagram illustrating a control system of the controller of the image forming apparatus according to the second exemplary embodiment of the present disclosure.

As shown in FIG. 15, an image forming apparatus 210 according to the second exemplary embodiment includes a controller 236 that controls each component.

The following description relates to control of the high-voltage power supply 68 by the controller 236.

The user sets a sheet member P in one of the containers 70 and touches the sample output unit 74*b* (see FIG. 6) of the input unit 74 to output a detection image as a black-color toner image. This causes the controller 236 to revolve the transfer belt 50 and to control the toner-image forming unit 30K and the first-transfer roller 52K, so as to transfer the detection image onto the transfer belt 50 in step S1100 in FIG. 14. Furthermore, the controller 236 controls the high-voltage power supply 68 so as to apply a voltage to the roller 32*b*. Moreover, the controller 236 controls the transport device 18 so as to transport the sheet member P contained in the container 70 along the transport path 16.

Figure 16:
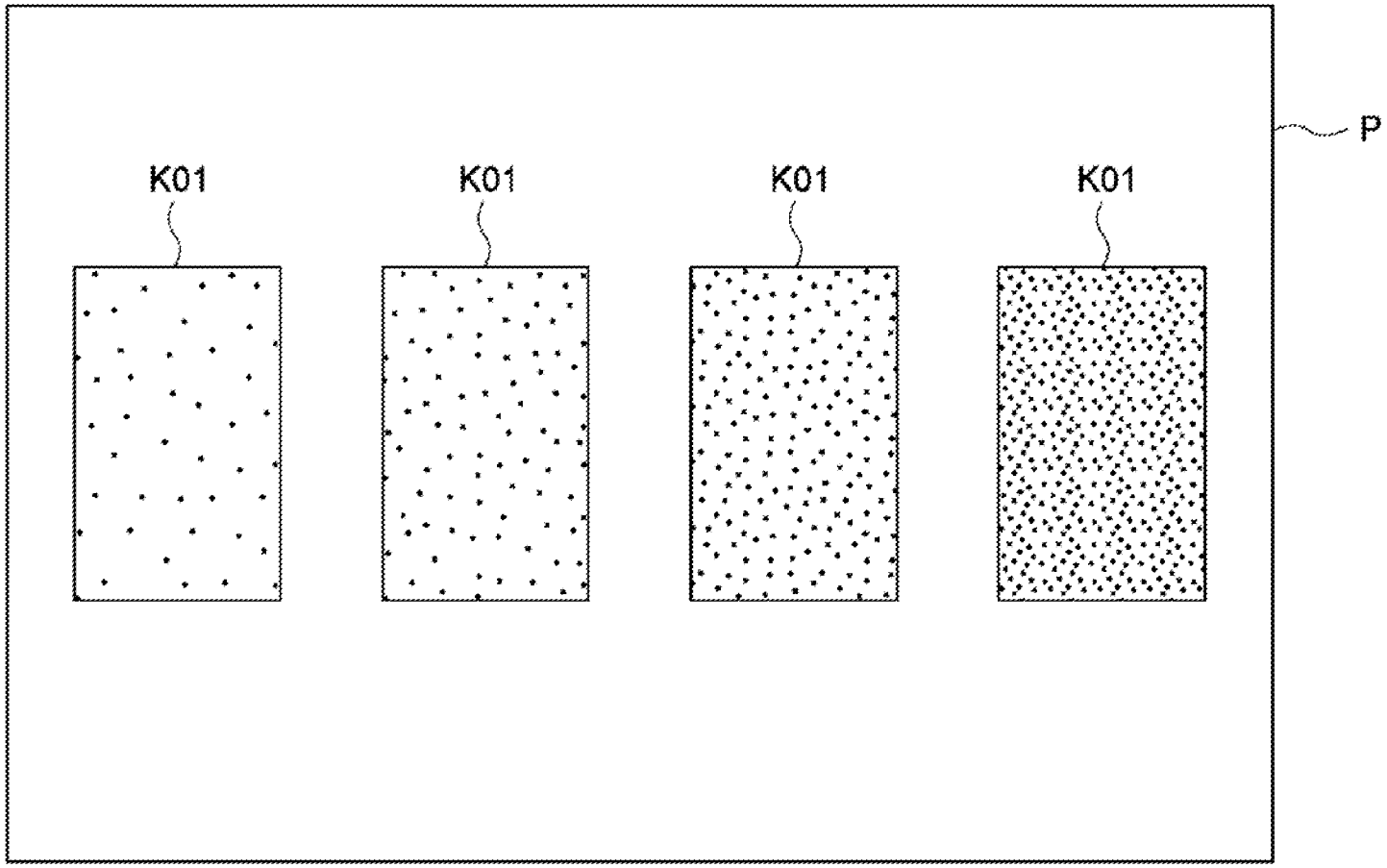
FIG. 16 illustrates detection images output by the image forming apparatus according to the second exemplary embodiment of the present disclosure.
Figure 17:
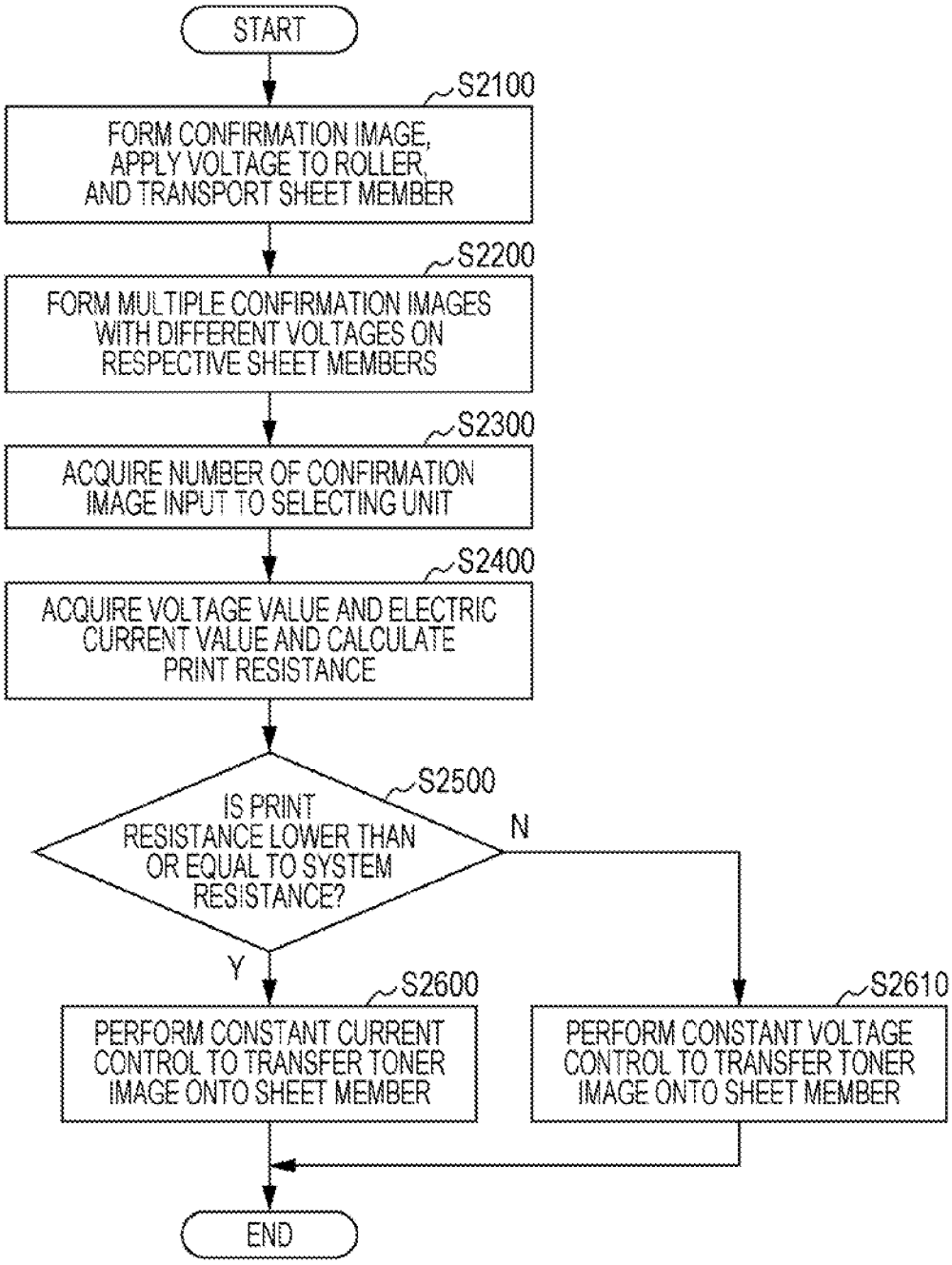
FIG. 17 is a flowchart illustrating the flow of control of each component by a controller of an image forming apparatus according to a third exemplary embodiment of the present disclosure.

In step S1200, the controller 236 causes multiple detection images K01 with different voltage values of voltages applied to the roller 32*b* to be transferred onto a single sheet member P at the second-transfer section NT, as shown in FIG. 16. In detail, the controller 236 controls the high-voltage power supply 68 to vary the voltage value of the voltage applied to the roller 32*b*, whereby multiple black-color detection images K01 are formed on the single sheet member P for the respective voltage values. Accordingly, multiple black-color detection images K01 with different toner image densities are formed on the single sheet member P.

In step S1300, the image inspector 24 detects the toner image density for each of the multiple detection images K01, and the controller 236 receives the detection result from the image inspector 24.

In step S1400, the controller 236 selects a detection image K01 with a toner image density closest to a target toner image density from the multiple detection images K01. Accordingly, the controller 236 functions as a density selector that selects a detection image with a toner image density closest to a target toner image density from multiple detection images.

Furthermore, the controller 236 acquires the voltage value of the voltage applied to the roller 32*b* when the selected detection image K01 is transferred. Moreover, the controller 236 acquires, from the ammeter 68*a*, the electric current value of the electric current flowing when this voltage is applied to the roller 32*b*. Then, the controller 236 calculates a print resistance from the acquired electric current value and the acquired voltage value.

In step S1500, the controller 236 determines whether or not the acquired print resistance is lower than or equal to the system resistance. If the print resistance is lower than or equal to the system resistance, it is determined that the sheet member P is a low-resistance medium, and the process proceeds to step S1600. If the print resistance is higher than the system resistance, it is determined that the sheet member P is plain paper, and the process proceeds to step S1610.

In step S1600, if a toner image is to be transferred onto the sheet member P determined as being a low-resistance medium, the controller 236 controls the high-voltage power supply 68 such that a predetermined electric current flows to the roller 32*b*. The controller 236 performs constant current control in this manner to transfer the toner image onto the sheet member P. Accordingly, the sequential operation ends.

In contrast, when the process proceeds to step S1610 as a result of the print resistance being higher than the system resistance, the controller 236 applies a voltage of a predetermined value to the roller 32*b* based on sheet-type information input to the sheet-type input unit 74*a* by the user. The controller 236 performs constant voltage control in this manner to transfer the toner image onto the sheet member P. Accordingly, the sequential operation ends.

Conclusion

As described above, in the image forming apparatus 210, the image inspector 24 detects the toner image density for each of the multiple detection images K01 formed by varying the voltage value, and the controller 236 selects a detection image K01 with a toner image density closest to a target toner image density from the multiple detection images K01. Furthermore, the controller 236 calculates a print resistance from the voltage value and the electric current value when the detection image K01 is transferred. Therefore, the accuracy of the print resistance to be calculated may be improved, so that the occurrence of a transfer defect of a toner image onto a low-resistance medium may be suppressed, as compared with a case where the print resistance is calculated without varying the voltage value of the voltage applied to the roller 32*b*.

Furthermore, in the image forming apparatus 210, the multiple black-color detection images K01 are formed on a single sheet member P. Accordingly, the time taken for calculating the print resistance may be shortened, as compared with a case where multiple detection images are formed on respective sheet members P.

Third Exemplary Embodiment

Figure 18:
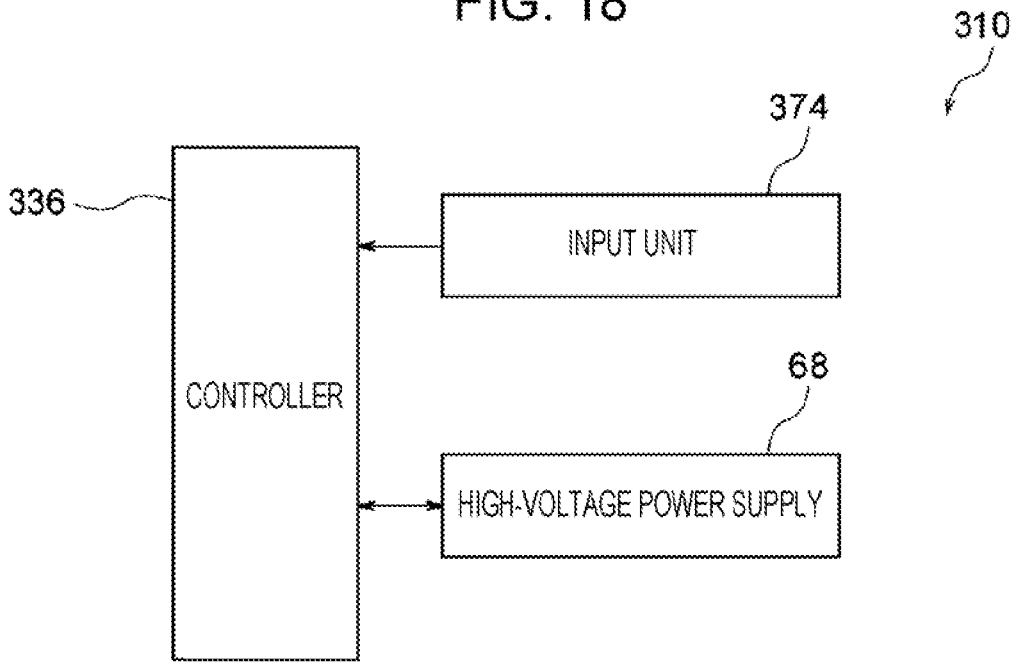
FIG. 18 is a block diagram illustrating a control system of the controller of the image forming apparatus according to the third exemplary embodiment of the present disclosure.
Figure 19:
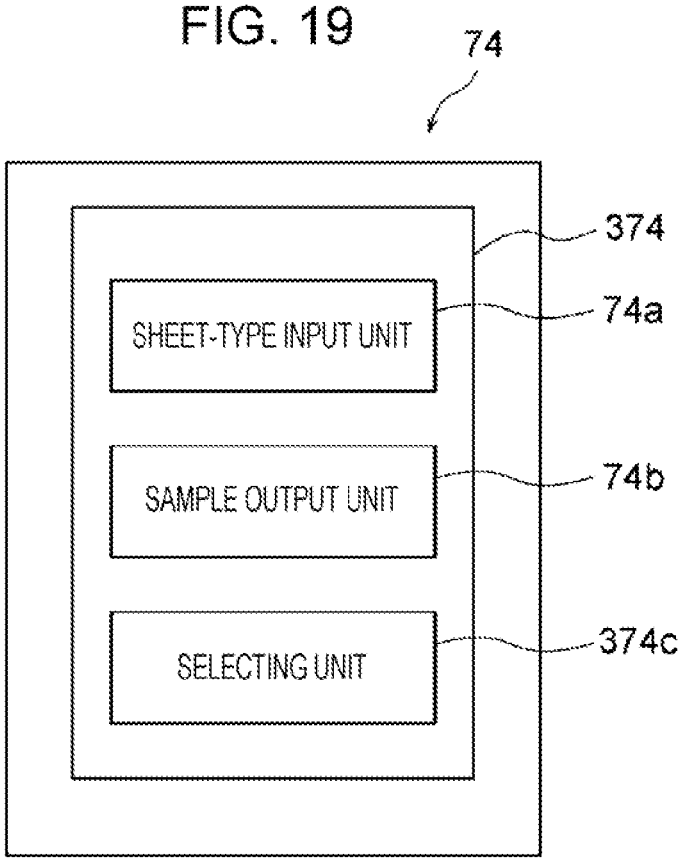
FIG. 19 illustrates the configuration of a part of a user interface of the image forming apparatus according to the third exemplary embodiment of the present disclosure.

An example of an image forming apparatus according to a third exemplary embodiment of the present disclosure will be described below with reference to FIGS. 17 to 20. In the third exemplary embodiment, features different from those in the first exemplary embodiment will be described. As shown in FIG. 19, an input unit 374 of an image forming apparatus 310 according to the third exemplary embodiment is provided with a sheet-type input unit 74*a*, a sample output unit 74*b* for outputting a confirmation image as a sample image to a sheet member P, and a selecting unit 374*c*. The selecting unit 374*c* will be described later. Furthermore, as shown in FIG. 18, the image forming apparatus 310 includes a controller 336 that controls each component.

The following description relates to control of the high-voltage power supply 68 by the controller 336.

The user sets a sheet member P in one of the containers 70 and touches the sample output unit 74*b* of the input unit 74 to output a confirmation image. This causes the controller 336 to revolve the transfer belt 50 and to control the toner-image forming unit 30K and the first-transfer roller 52K, so as to transfer the confirmation image onto the transfer belt 50 in step S2100 in FIG. 17. Furthermore, the controller 336 controls the high-voltage power supply 68 so as to apply a voltage to the roller 32*b*. Moreover, the controller 336 controls the transport device 18 so as to transport the sheet member P contained in the container 70 along the transport path 16.

Figure 20:
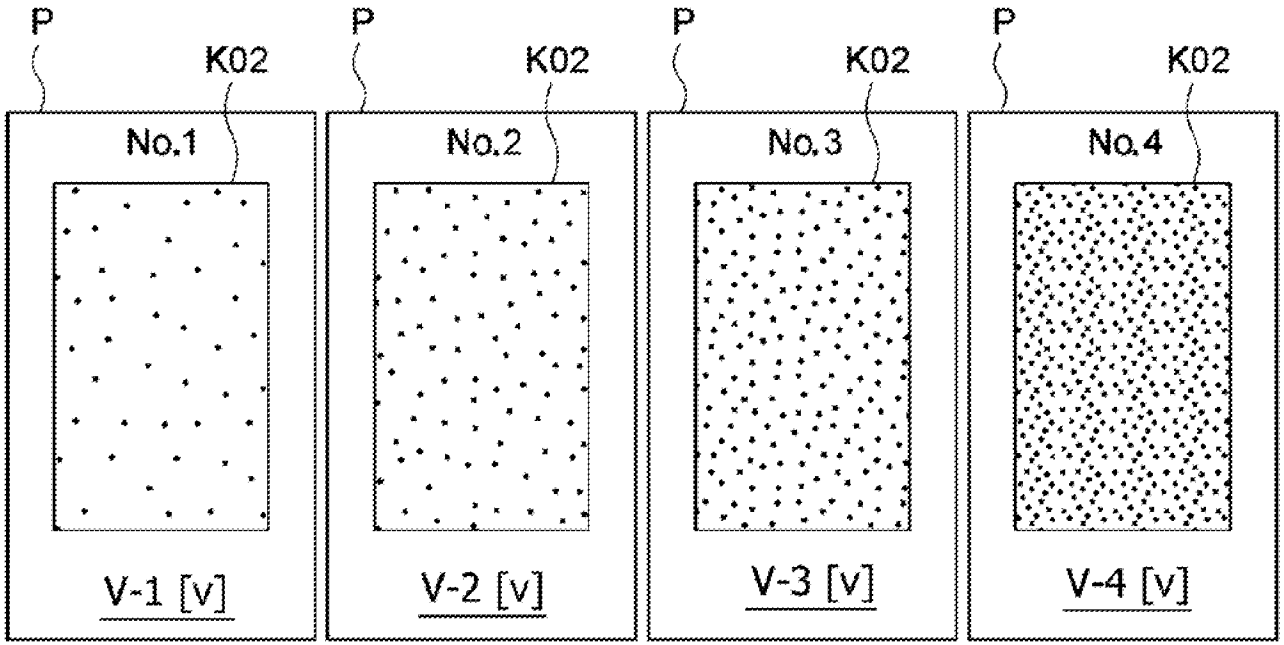
FIG. 20 illustrates confirmation images output by the image forming apparatus according to the third exemplary embodiment of the present disclosure.

In step S2200, the controller 336 causes multiple confirmation images K02 with different voltage values of voltages applied to the roller 32*b* to be formed on respective sheet members P at the second-transfer section NT, as shown in FIG. 20. In detail, the controller 336 controls the high-voltage power supply 68 to vary the voltage value of the voltage applied to the roller 32*b*, whereby multiple black-color confirmation images K02 are formed on the respective sheet members P for the respective voltage values. Accordingly, multiple black-color confirmation images K02 with different toner image densities are formed on the respective sheet members P.

In this case, the controller 336 controls each component so that, on each sheet member P, the value of a voltage applied to the roller 32*b* when a confirmation image K02 is transferred onto the sheet member P and the number of the confirmation image K02 are formed. The value of the voltage and the number are an example of information about the confirmation image K02.

In step S2300, the controller 336 acquires the number of a confirmation image K02 input to the selecting unit 374*c* by the user.

In detail, the user checks the confirmation image K02 on each sheet member P output in step S2200. Moreover, the user selects a confirmation image K02 with a toner image density closest to a target toner image density and inputs the number of that confirmation image K02 to the selecting unit 374*c*. Then, the controller 336 acquires the number of the confirmation image K02 input to the selecting unit 374*c* by the user.

In step S2400, the controller 336 acquires the voltage value of the voltage applied to the roller 32*b* when the selected confirmation image K02 is transferred. Furthermore, the controller 336 acquires, from the ammeter 68*a*, the electric current value of the electric current flowing when this voltage is applied to the roller 32*b*. Then, the controller 236 calculates a print resistance from the acquired electric current value and the acquired voltage value.

In step S2500, the controller 336 determines whether or not the acquired print resistance is lower than or equal to the system resistance. If the print resistance is lower than or equal to the system resistance, it is determined that the sheet member P is a low-resistance medium, and the process proceeds to step S2600. If the print resistance is higher than the system resistance, it is determined that the sheet member P is plain paper, and the process proceeds to step S2610.

In step S2600, if a toner image is to be transferred onto the sheet member P determined as being a low-resistance medium, the controller 336 controls the high-voltage power supply 68 to apply a predetermined electric current to the roller 32*b*. Specifically, the controller 336 performs constant current control to transfer the toner image onto the sheet member P. Accordingly, the sequential operation ends.

In contrast, when the process proceeds to step S3610 as a result of the print resistance being higher than the system resistance, the controller 336 applies a voltage of a predetermined value to the roller 32*b* based on sheet-type information input to the sheet-type input unit 74*a* by the user. The controller 336 performs constant voltage control in this manner to transfer the toner image onto the sheet member P. Accordingly, the sequential operation ends.

Conclusion

As described above, in the image forming apparatus 310, multiple confirmation images K02 formed by varying the voltage value are formed on respective sheet members P. Then, the controller 336 acquires the number of a confirmation image K02 input to the selecting unit 374*c* by the user, and calculates a print resistance from the voltage value and the electric current value when that confirmation image K02 is transferred. Therefore, the accuracy of a print resistance to be calculated may be improved, so that the occurrence of a transfer defect of a toner image onto a low-resistance medium may be suppressed, as compared with a case where the print resistance is calculated without varying the voltage value of the voltage applied to the roller 32*b*.

Furthermore, in the image forming apparatus 310, the voltage value of the voltage applied to each confirmation image K02 and the number of the confirmation image K02 are formed on the corresponding sheet member P. Therefore, a confirmation image K02 may be readily selected by the user.

Furthermore, in the image forming apparatus 310, multiple confirmation images K02 formed by varying the voltage value are formed on respective sheet members P. Therefore, as compared with a case where multiple confirmation images with different voltage values are formed on a single sheet member P, the voltage value does not have to be varied within a single sheet member P, so that the toner image density of the confirmation image K02 transferred onto the sheet member P is stable, whereby the accuracy of a print resistance to be calculated may be improved.

Although specific exemplary embodiments of the present disclosure have been described in detail, it is obvious to a skilled person that the present disclosure is not limited to the exemplary embodiments and that various exemplary embodiments are possible within the scope of the disclosure. For example, although not specifically described in the first exemplary embodiment, the sample image may be or may not be transferred onto the sheet member P in step S200, so long as the value of the electric current flowing when the sheet member P is nipped at the second-transfer section NT is acquirable.

As an alternative to the second or third exemplary embodiment in which the electric current value for a low-resistance medium preliminarily stored in the image forming apparatus 210 or 310 is used when constant current control is performed, an acquired electric current value may be used in step S1400 or S2400. Accordingly, even when an electric current value for a low-resistance medium is not preliminarily stored, constant current control is executed on a low-resistance medium.

As an alternative to the second exemplary embodiment in which multiple detection images K01 are formed on a single sheet member P, multiple detection images may be formed on respective sheet members P. In this case, the advantage achieved by forming multiple detection images K01 on a single sheet member P is not exhibited.

As an alternative to the third exemplary embodiment in which multiple confirmation images K02 formed by varying the voltage value are formed on respective sheet members P, multiple confirmation images K02 may be formed on a single sheet member P. However, in this case, the advantage achieved by forming multiple confirmation images K02 on respective sheet members P is not exhibited.

As an alternative to the third exemplary embodiment in which the voltage value of the voltage applied to the roller 32*b* is displayed on each sheet member P, the voltage value does not have to be displayed. However, in this case, the advantage achieved by displaying the voltage value on the sheet member P is not exhibited.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

a revolving belt configured to revolve and retain a toner image on a peripheral surface thereof;

a transfer member configured to nip a transported recording medium and the revolving belt at a nipping section and transfer the toner image retained by the revolving belt onto the recording medium by receiving a voltage;

a guide connected to ground, and configured to guide the recording medium to the nipping section and be in contact with the recording medium nipped at the nipping section; and a controller configured to determine whether a print resistance is lower than or equal to a system resistance and perform constant current control to transfer the toner image onto the recording medium if it is determined that the print resistance is lower than or equal to a system resistance, the print resistance corresponding to when the voltage is applied to the transfer member in a state where the recording medium is nipped at the nipping section, the system resistance corresponding to when the voltage is applied to the transfer member in a state where the recording medium is not nipped at the nipping section.

2. The image forming apparatus according to claim 1, wherein the controller performs constant voltage control to transfer the toner image onto the recording medium if the determined print resistance is higher than the system resistance.

3. The image forming apparatus according to claim 2, wherein the controller determines the print resistance by calculating the print resistance in accordance with the voltage applied to the transfer member in the state where the recording medium is nipped at the nipping section and an electric current flowing when the voltage is applied.

4. The image forming apparatus according to claim 2, further comprising:

a detector configured to detect image densities of a plurality of detection images as toner images transferred onto the recording medium, wherein the controller is configured to cause the plurality of detection images to be transferred onto the recording medium while varying the voltage applied to the transfer member to a plurality of values when the detection images are transferred onto the recording medium, select one of the detection images from the image densities of the plurality of detection images detected by the detector, and calculate the print resistance in accordance with a voltage when the selected detection image is transferred and an electric current flowing when the voltage is applied.

5. The image forming apparatus according to claim 4, wherein the controller is configured to cause the plurality of detection images to be transferred onto a single recording medium.

6. The image forming apparatus according to claim 2, further comprising:

an input interface configured to input information about one of a plurality of confirmation images as toner images transferred onto the recording medium, the one confirmation image being selectable from the plurality of confirmation images, wherein the controller is configured to cause the plurality of confirmation images to be transferred onto the recording medium while varying the voltage applied to the transfer member to a plurality of values when the confirmation images are transferred onto the recording medium, and to calculate the print resistance in accordance with a voltage when the input confirmation image is transferred and an electric current flows when the voltage is applied, based on the information about the confirmation image input to the input interface.

7. The image forming apparatus according to claim 6, wherein the controller is configured to cause the information about the confirmation image applied to the transfer member to be displayed on the recording medium when the confirmation image is to be transferred onto the recording medium.

8. The image forming apparatus according to claim 6, wherein input interface is a user interface.

9. The image forming apparatus according to claim 6, wherein the one confirmation image being selectable from the plurality of confirmation images is configured to be selected by a user of the image forming apparatus.

10. The image forming apparatus according to claim 1, wherein the controller determines the print resistance by calculating the print resistance in accordance with the voltage applied to the transfer member in the state where the recording medium is nipped at the nipping section and an electric current flowing when the voltage is applied.

11. The image forming apparatus according to claim 1, further comprising:

a detector configured to detect image densities of a plurality of detection images as toner images transferred onto the recording medium, wherein the controller is configured to cause the plurality of detection images to be transferred onto the recording medium while varying the voltage applied to the transfer member to a plurality of values when the detection images are transferred onto the recording medium, select one of the detection images from the image densities of the plurality of detection images detected by the detector, and calculate the print resistance in accordance with a voltage when the selected detection image is transferred and an electric current flowing when the voltage is applied.

12. The image forming apparatus according to claim 11, wherein the controller is configured to cause the plurality of detection images to be transferred onto a single recording medium.

13. The image forming apparatus according to claim 1, further comprising:

an input interface configured to input information about one of a plurality of confirmation images as toner images transferred onto the recording medium, the one confirmation image being selectable from the plurality of confirmation images, wherein the controller is configured to cause the plurality of confirmation images to be transferred onto the recording medium while varying the voltage applied to the transfer member to a plurality of values when the confirmation images are transferred onto the recording medium, and to calculate the print resistance in accordance with a voltage when the input confirmation image is transferred and an electric current flows when the voltage is applied, based on the information about the confirmation image input to the input interface.

14. The image forming apparatus according to claim 13, wherein the controller is configured to cause the information about the confirmation image applied to the transfer member to be displayed on the recording medium when the confirmation image is to be transferred onto the recording medium.

15. The image forming apparatus according to claim 13, wherein input interface is a user interface.

16. The image forming apparatus according to claim 13, wherein the one confirmation image being selectable from the plurality of confirmation images is configured to be selected by a user of the image forming apparatus.

17. A image forming apparatus comprising:

revolving means for retaining a toner image on a peripheral surface thereof;

transferring means for nipping a transported recording medium and the revolving means at a nipping section and for transferring the toner image retained by the revolving means onto the recording medium by receiving a voltage;

guiding means connected to ground, the guiding means guiding the recording medium to the nipping section and being in contact with the recording medium nipped at the nipping section; and control means for determining whether a print resistance is lower than or equal to a system resistance and performing constant current control to transfer the toner image onto the recording medium if it is determined that the print resistance is lower than or equal to the system resistance, the print resistance corresponding to when the voltage is applied to the transferring means in a state where the recording medium is nipped at the nipping section, the system resistance corresponding to when the voltage is applied to the transferring means in a state where the recording medium is not nipped at the nipping section.

* * * * *